US012084264B2

(12) United States Patent
Cooper

(10) Patent No.: US 12,084,264 B2
(45) Date of Patent: Sep. 10, 2024

(54) PACKAGING SYSTEM FOR A BICYCLE

(71) Applicant: Specialized Bicycle Components, Inc., Morgan Hill, CA (US)

(72) Inventor: Thomas S. Cooper, Gilroy, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 15 days.

(21) Appl. No.: 17/976,334

(22) Filed: Oct. 28, 2022

(65) Prior Publication Data

US 2024/0140689 A1 May 2, 2024

(51) Int. Cl.
*B65D 85/68* (2006.01)
*B65B 5/02* (2006.01)
(Continued)

(52) U.S. Cl.
CPC ..... *B65D 85/68* (2013.01); *B65B 5/028* (2013.01); *B65B 5/04* (2013.01); *B65D 5/321* (2013.01);
(Continued)

(58) Field of Classification Search
CPC ..... B65D 5/02; B65D 5/028; B65D 5/04321; B65D 5/50; B65D 5/5038; B65D 51/24;
(Continued)

(56) References Cited

U.S. PATENT DOCUMENTS 3,929,225 A 12/1975 Locke et al.
5,040,721 A 8/1991 Essack
(Continued)

FOREIGN PATENT DOCUMENTS

DE 102006019348 A1 10/2007
DE 202017001816 U1 8/2018
(Continued)

OTHER PUBLICATIONS

Cote, A. Patent Watch: Trek, Canyon and others patent bike boxes for the D2C market. Bicycle Retailer and Industry News. Available online at https://www.bicycleretailer.com/industry-news/2021/10/14/patent-watch-trek-canyon-and-others-patent-bike-boxes-d2c-market (11 pages).
(Continued)

*Primary Examiner* — Bryon P Gehman
(74) *Attorney, Agent, or Firm* — Michael Best & Friedrich LLP

(57) ABSTRACT

A packaging system for a bicycle, the packaging system including a base tray having a first tab, a second tab located opposite the first tab, a first side extending between the first tab and the second tab, and a second side extending between the first tab and the second tab and located opposite the first side. The packaging system further includes a first vertical tower having a first aperture configured to receive the first tab of the base tray to interlock the first vertical tower to the base tray at the first end, a second vertical tower having a second aperture configured to receive the second tab of the base tray to interlock the second vertical tower to the base tray at the second end, and an outer carton configured to surround and interlock with the base tray, the first vertical tower, and the second vertical tower.

20 Claims, 20 Drawing Sheets

(51) Int. Cl.
*B65B 5/04* (2006.01)
*B65D 5/32* (2006.01)
*B65D 5/50* (2006.01)

(52) U.S. Cl.
CPC .... *B65D 5/5038* (2013.01); *B65D 2585/6862* (2013.01)

(58) Field of Classification Search
CPC .... B65D 51/248; B65D 81/133; B65D 85/68; B65D 85/6862; B65D 2585/6862
USPC ..... 206/335
See application file for complete search history.

(56) References Cited

U.S. PATENT DOCUMENTS

| | | | | |
|---|---|---|---|---|
| 5,385,293 | A | 1/1995 | Hirota et al. | |
| 5,669,497 | A | 9/1997 | Evans et al. | |
| D640,624 | S | 6/2011 | Valiquette | |
| 8,820,004 | B1 | 9/2014 | Jeffords | |
| D723,452 | S | 3/2015 | Carlson | |
| 9,266,575 | B1 | 2/2016 | Hed | |
| D764,411 | S | 8/2016 | Sondors et al. | |
| D803,142 | S | 11/2017 | Bauer et al. | |
| D816,585 | S | 5/2018 | Doughty | |
| D816,586 | S | 5/2018 | Doughty | |
| 10,017,222 | B2 | 7/2018 | Carlson | |
| 10,144,578 | B2 | 12/2018 | Chen et al. | |
| 10,173,740 | B2 | 1/2019 | Yeh | |
| 10,351,200 | B2 | 7/2019 | Moore | |
| 10,427,743 | B2 | 10/2019 | Hed | |
| D873,657 | S | 1/2020 | Barker | |
| 10,703,429 | B2 | 7/2020 | Fiedler et al. | |
| 10,745,183 | B2 | 8/2020 | Allen | |
| 10,766,691 | B2 | 9/2020 | Barker | |
| 10,875,594 | B2 | 12/2020 | Zhou et al. | |
| D910,440 | S | 2/2021 | Collins | |
| D911,164 | S | 2/2021 | Barker | |
| D927,364 | S | 8/2021 | Zappa | |
| 11,242,194 | B2 * | 2/2022 | Rogers | B65D 81/133 |
| 11,414,262 | B2 * | 8/2022 | Keiller | B65D 85/68 |
| 11,530,088 | B2 * | 12/2022 | Neuhofer | B65D 85/68 |
| 2011/0042263 | A1 | 2/2011 | Kemper | |
| 2017/0066588 | A1 | 3/2017 | Schreiber et al. | |
| 2018/0290820 | A1 | 10/2018 | Keiller | |
| 2019/0061863 | A1 | 2/2019 | Lee et al. | |
| 2020/0017286 | A1 | 1/2020 | Barker | |
| 2020/0070917 | A1 | 3/2020 | Hed | |
| 2020/0346848 | A1 | 11/2020 | Keiller | |
| 2020/0354141 | A1 | 11/2020 | Barker | |
| 2021/0129312 | A1 | 5/2021 | Caratiola | |
| 2021/0130082 | A1 | 5/2021 | Ku et al. | |
| 2021/0269230 | A1 | 9/2021 | Rogers | |

FOREIGN PATENT DOCUMENTS

| | | | | |
|---|---|---|---|---|
| DE | 202019106107 | U1 | 3/2021 | |
| EP | 2239210 | B1 | 7/2013 | |
| EP | 3378730 | A1 | 9/2018 | |
| EP | 3202649 | B1 | 4/2019 | |
| EP | 3527470 | A1 | 8/2019 | |
| EP | 3281852 | B1 | 11/2019 | |
| EP | 3281853 | B1 | 11/2019 | |
| EP | 3766803 | A1 | 1/2021 | |
| EP | 3778364 | A1 | 2/2021 | |
| EP | 3786039 | A1 | 3/2021 | |
| EP | 3786040 | A1 | 3/2021 | |
| EP | 3788907 | A1 | 3/2021 | |
| EP | 3611106 | B1 * | 8/2021 | B65D 5/68 |
| EP | 3871990 | A1 | 9/2021 | |
| EP | 3878727 | A1 | 9/2021 | |
| JP | 2003321082 | A * | 11/2003 | B65D 85/68 |
| TW | I582022 | B | 5/2017 | |
| TW | I680085 | B | 12/2019 | |

OTHER PUBLICATIONS

Bacon, D. Bicycle Packaging System by Trek. Wheelbased. Available online at https://wheelbased.com/2021/10/11/bibycle-packaging-system-by-trek/ (13 pages).

Instagram. Trekbikes comment on Wheel_based post. Accessed on Oct. 16, 2021. Available online at https://www.instagram.com/p/CU6B2YWFdY8/ (2 pages).

* cited by examiner

PACKAGING SYSTEM FOR A BICYCLE

BACKGROUND

The present disclosure relates to a packaging system for a bicycle.

DETAILED DESCRIPTION

Figure 1:
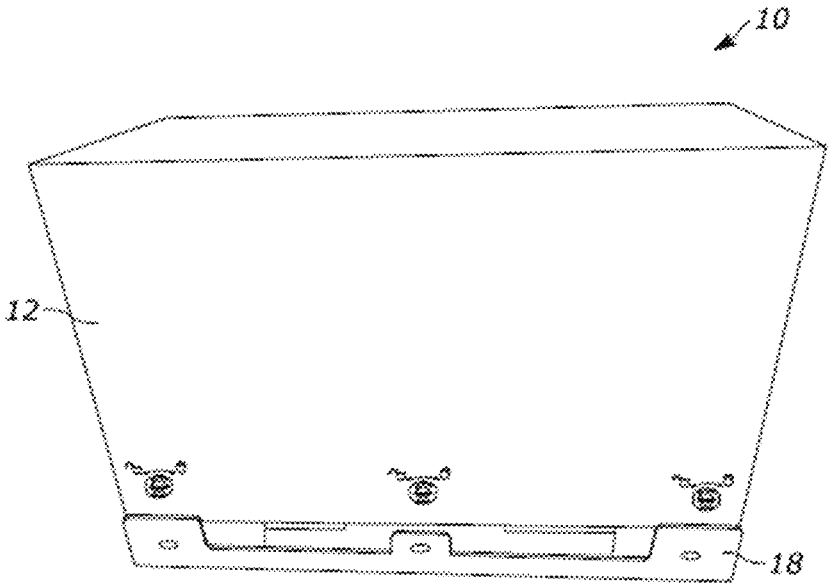
FIG. 1 is a front view of a packaging system in an open configuration, according to an embodiment.

Before any constructions of the disclosure are explained in detail, it is to be understood that the disclosure is not limited in its application to the details of construction and the arrangement of components set forth in the following description or illustrated in the accompanying drawings. The disclosure is capable of supporting other constructions and of being practiced or of being carried out in various ways.

According to an exemplary embodiment, a packaging system for a bicycle includes a base tray having a first tab defining a first end, a second tab located opposite the first tab and defining a second end, a first side extending between the first tab and the second tab, and a second side extending between the first tab and the second tab and located opposite the first side, the first side and the second side defining a length of the base tray. The packaging system also comprises a first vertical tower having a first aperture configured to receive the first tab of the base tray to interlock the first vertical tower to the base tray at the first end, a second vertical tower having a second aperture configured to receive the second tab of the base tray to interlock the second vertical tower to the base tray at the second end, and an outer carton configured to surround and interlock with the base tray, the first vertical tower, and the second vertical tower.

According to another exemplary embodiment, a base tray is configured to be coupled to a first vertical tower and a second vertical tower, wherein the base tray, the first vertical tower, and the second vertical tower are configured to be surrounded by an outer carton to form a packaging system for a bicycle. The base tray includes a bottom layer having a central panel, a first side panel formed on a first side of the central panel, and a second side panel formed on a second side of the central panel of the bottom layer and located opposite the first side panel. The base tray also includes a top layer having a central panel, a third side panel formed on a first side of the central panel, and a fourth side panel formed on a second side of the central panel of the top layer. The base tray further includes an intermediate layer disposed between the top layer and the bottom layer such that the bottom layer is positioned underneath the intermediate layer and the top layer.

According to another exemplary embodiment, a method of assembling a packaging system for a bicycle is provided. The packaging system includes a base tray having a first tab defining a first end and a second tab located opposite the first end and defining a second end, a first vertical tower, a second vertical tower, a third vertical tower, and an outer carton configured to slide over each of the base tray, the first vertical tower, the second vertical tower, and the third vertical tower. The method includes inserting the first tab of the base tray into a first aperture formed within the first vertical tower to interlock the first vertical tower to the base tray at the first end, positioning the bicycle onto the base tray such that the base tray is disposed underneath the bicycle and the first vertical tower partially surrounds a rear wheel of the bicycle, interlocking the third vertical tower with the first vertical tower as the third vertical tower engages a frame of the bicycle, inserting the second tab of the base tray into a second aperture formed within the second vertical tower to interlock the second vertical tower to the base tray at the second end such that the second vertical tower partially surrounds a front wheel of the bicycle, and sliding the outer carton over the base tray, the first vertical tower, the second vertical, and the third vertical tower.

Figure 27:
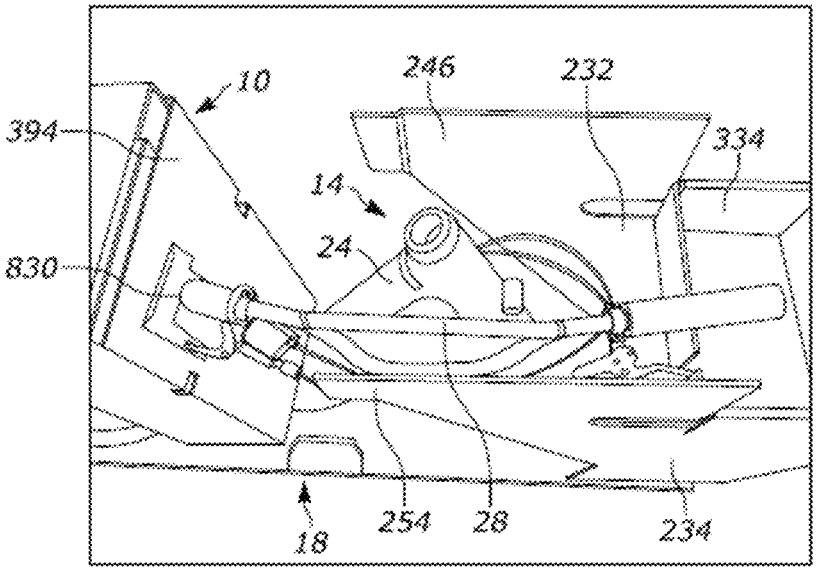
FIG. 27 is a top perspective view of the front vertical tower of FIG. 4 and the center vertical tower of FIG. 6.
Figure 28:
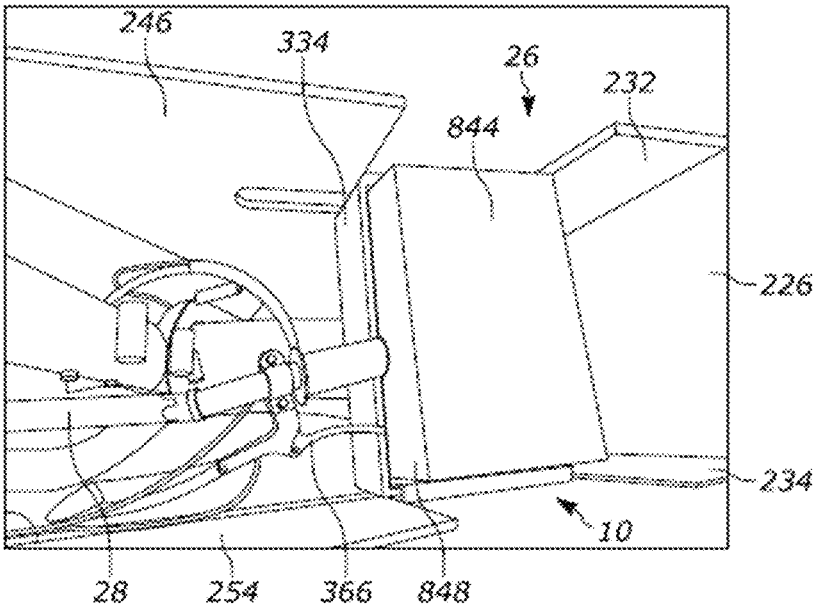
FIG. 28 is a top perspective view of the front vertical tower of FIG. 4 and the handlebar tray of FIG. 5 with a handlebar cap.

FIGS. 1-32 illustrate a packaging system 10 to support various types of bicycles during transportation (e.g., shipment). The packaging system 10 may include an outer carton 12 sized and shaped to at least partially surround a bicycle 14. The bicycle 14 (FIG. 16) may include a front wheel 16, a rear wheel 20, a frame 24 coupled to and supported on the front wheel 16 and the rear wheel 20, and a handlebar 28 (FIGS. 27 and 28). In the illustrated embodiment, the handlebar 28 is detached from the frame 24. In some embodiments, the packaging system 10 may support a large mountain bicycle, or other heavier type of bicycle. In other embodiments, the packaging system 10 may support a more light-weight road bicycle, or other type of bicycle. In some embodiments, the packaging system 10 may support an electric bicycle (ebike) and/or a utility bicycle.

Figure 2:
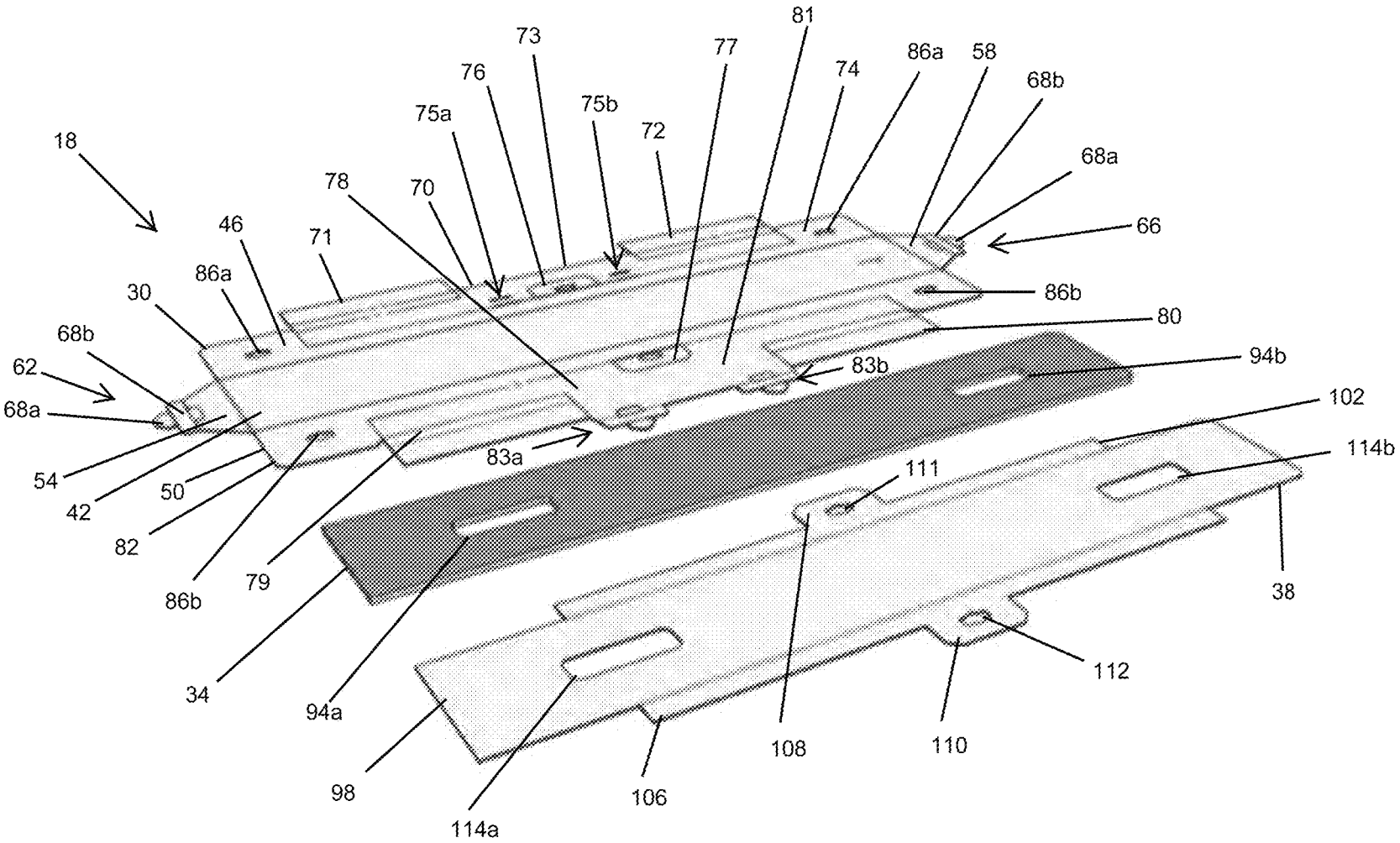
FIG. 2 is a perspective view of a base tray of the packaging system of FIG. 1, in an unfolded configuration.
Figure 3:
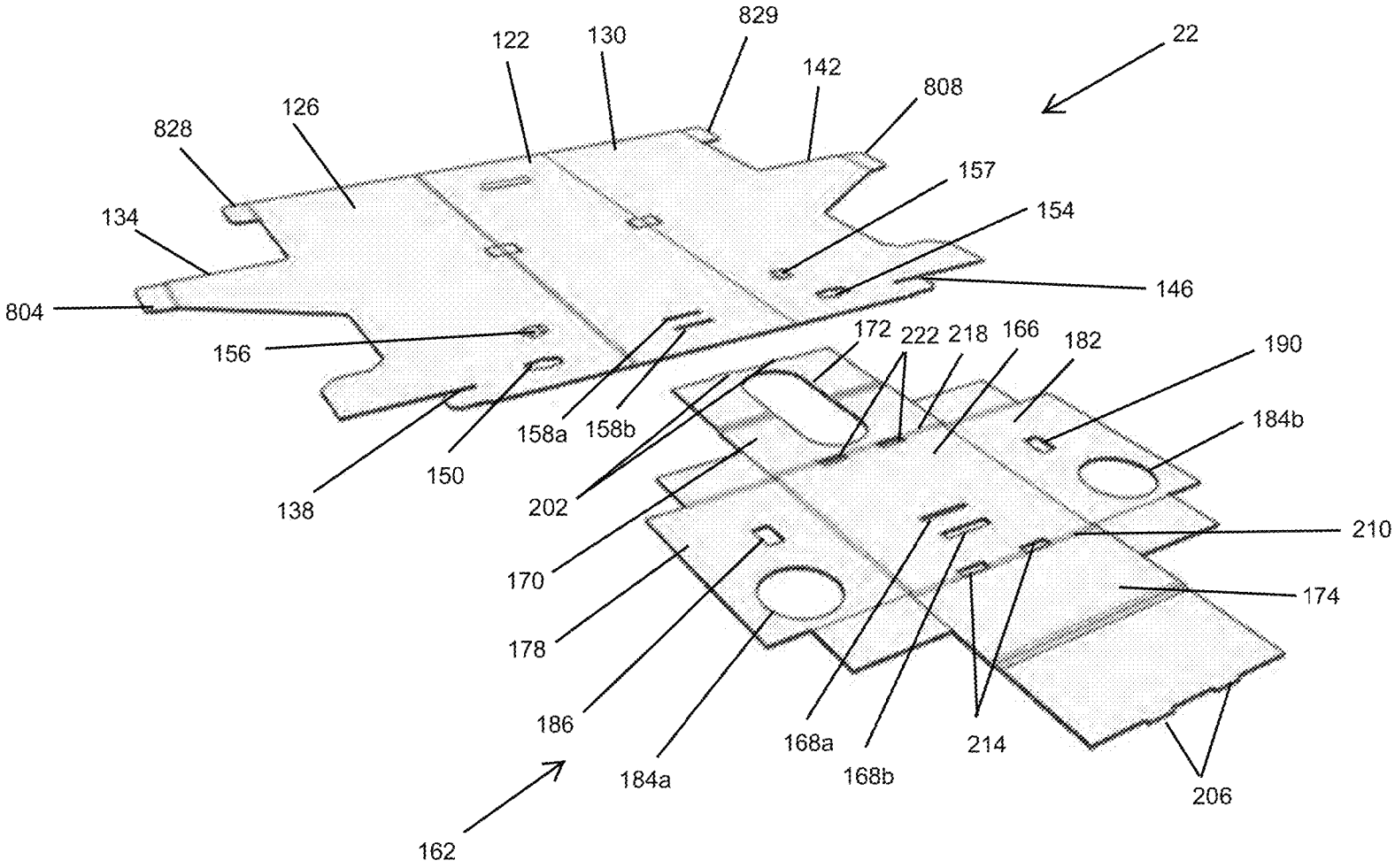
FIG. 3 is a perspective view of a rear vertical tower and a rear wheel brace of the packaging system of FIG. 1, in an unfolded configuration.
Figure 4:
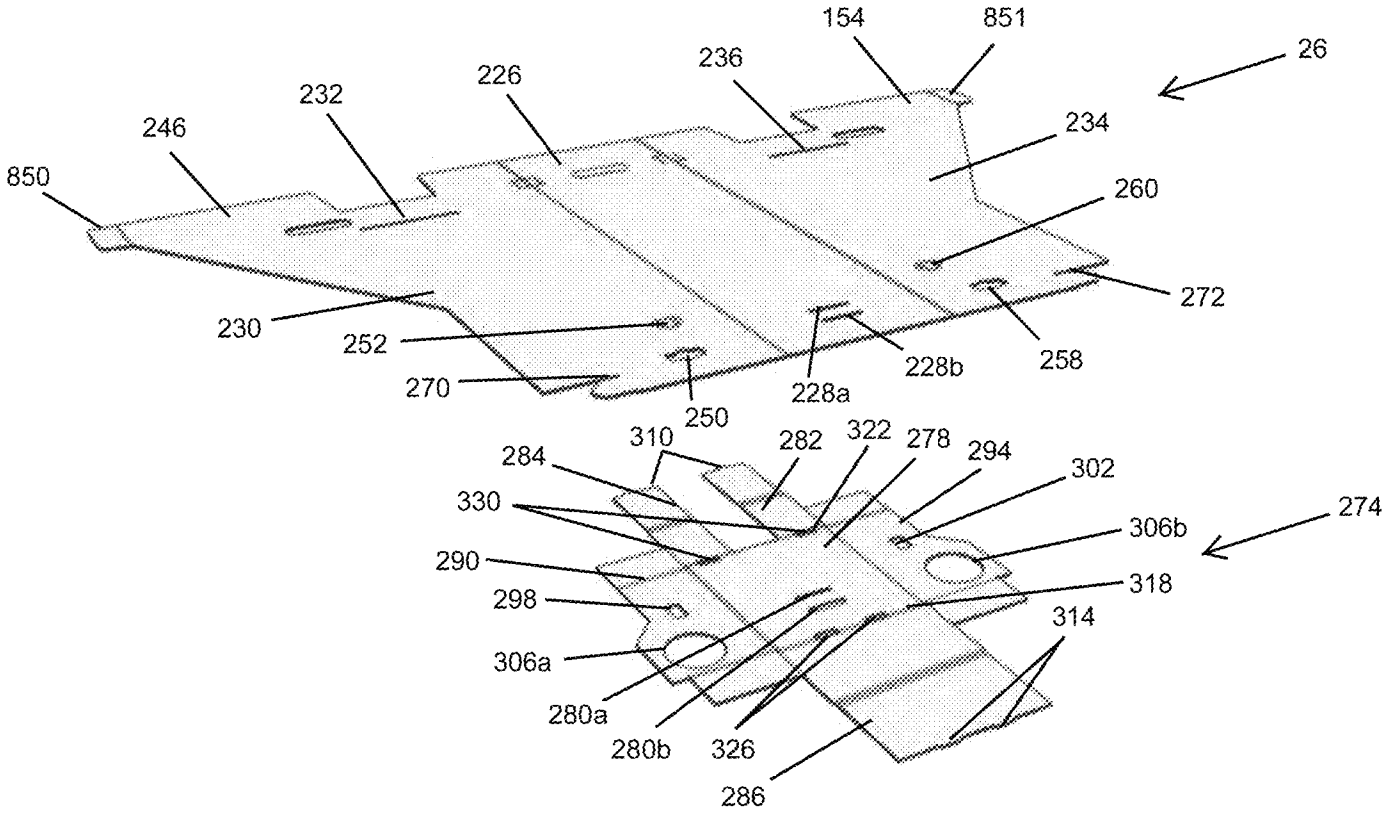
FIG. 4 is a perspective view of a front vertical tower and a front wheel brace of the packaging system of FIG. 1, in an unfolded configuration.

With reference to FIGS. 2-4, the packaging system 10 may include a base tray 18, a rear tower 22, and/or a front tower 26. The base tray 18 may be formed, for example, by a bottom layer 30, an intermediate layer 34, and/or a top layer 38. A multi-layered base tray 18 may, for example, allow the packaging system 10 to support heavier bicycles during transportation of the packaging system 10.

With reference to FIG. 2, the bottom layer 30 may include a central panel 42, a first side panel 46, a second side panel 50, a rear tab 54, and/or a front tab 58. The first side panel 46 may extend from a first lateral side of the central panel 42 and the second side panel 50 may extend from a second lateral side of the central panel 42. The second side panel 50 may be located opposite the first side panel 46. The rear tab 54 may extend from a first end of the central panel 42 and the front tab 58 may extend from a second, opposite end of the central panel 42. The front tab 58 may be located opposite the rear tab 54. The first and second side panels 46, 50 may extend, for example, between the rear and front tabs 54, 58 of the bottom layer 30. The bottom layer 30 may include crease lines configured to define which portions of the bottom layer 30 may be folded or torn when assembling the packaging system 10. The crease lines may be perforated, for example, for tearing. The bottom layer 30 may also define a length of base tray 18. This length may extend, for example, between the rear and front tabs 54, 58. In some embodiments, the bottom layer 30 may be corrugated. In some embodiments, the bottom layer 30 may include an EB flute cardboard material.

With continued reference to FIG. 2, the rear tab 54 of the bottom layer 30 may include a rear tower locking member 62, and the front tab 58 of the bottom layer 30 may include a front tower locking member 66. The rear and front tower locking members 62, 66 may both be formed by a cross-like structure having a first flap 68*a* and a second flap 68*b*. The first flap 68*a* may extend in a direction parallel to the length of the base tray 18, while the second flap 68*b* may extend in a direction perpendicular to the length of the base tray 18.

As illustrated in FIG. 2, the first side panel 46 of the bottom layer 30 may include a first central portion 70 and a first exterior portion 74 surrounding an external periphery of the first central portion 70 (e.g., wrapping around a portion of the first central portion 70). The first exterior portion 74 may be connected to the central panel 42. As such, at least a portion of the first exterior portion 74 may be located between the first central portion 70 and the central panel 42. The second side panel 50 may include a second central portion 78 and a second exterior portion 82 surrounding an external periphery of the second central portion 74 (e.g., wrapping around a portion of the second central portion 78). The second exterior portion 82 may be connected to the central panel 42. As such, at least a portion of the second exterior portion 82 may be located between the second central portion 82 and the central panel 42. The first and second exterior portions 74, 82 may each include locking apertures 86*a*, 86*b* configured to receive a locking clip 92 (FIG. 31) discussed in detail herein below.

With continued reference to FIG. 2, the first central portion 70 of the bottom layer 30 may include a rear flap 71, a front flap 72, a central flap 73 having slots 75*a*, 75*b*, and/or a tab 76 disposed between the slots 75*a*, 75*b*. The central flap 73 may be connected to the rear and front flaps 71, 72, and the rear and front flaps 71, 72 may be located opposite each other. The tab 76 of the first central portion 70 may form a recess (not shown) when folded away from the central flap 73. The second central portion 78 may include a rear flap 79, a front flap 80, and a central flap 81 that extends laterally beyond the rear and front flaps 79, 80. The central flap 81 may be connected to the rear and front flaps 71,72 while the rear and front flaps 71,72 are located opposite each other. The central flap 81 of the second central portion 78 may include a tab 77 centrally disposed and locking members 83*a*, 83*b* similar to the rear and front tower locking members 62, 66 of the rear and front tabs 54, 58. The tab 77 of the second central portion 78 may form a recess (not shown) when folded away from the central flap 81. When the bottom layer 30 is in a folded position (FIGS. 12 and 13), the locking members 83*a*, 83*b* of the central flap 81 may be received, respectively, within the slots 75*a*, 75*b* of the central flap 73. In some embodiments, the tab 76 may extend into the recess formed by the tab 77, and the tab 77 may extend into the recess formed by the tab 76.

With reference to FIG. 2, the intermediate layer 34 may include slots 94*a*, 94*b* spaced from each other such that a gap is formed therebetween. The slots 94*a*, 94*b* may respectively receive the front wheel 16 and the rear wheel 20 of the bicycle 14. The intermediate layer 34 may be formed, for example, of a honeycomb cardboard, or other material.

With continued reference to FIG. 2, the top layer 38 may include a central panel 98, a first side panel 102, and/or a second side panel 106. The first side panel 102 may extend from a first lateral side of the central panel 98. The second side panel 106 may extend from a second lateral side of the central panel 98, and may be located opposite the first side panel 102. The first side panel 102 may include a first tab 108 with an aperture 111 extending therethrough. The second side panel 106 may include a second tab 110 with an aperture 112 extending therethrough. Slots 114*a*, 114*b* may be formed within the central panel 98 of the top layer 38. The slots 114*a*, 114*b* may respectively receive the front wheel 16 and the rear wheel 20 of the bicycle 14. In some embodiments, the top layer 38 may be corrugated. In some embodiments, the top layer 38 may include an EB flute cardboard material.

Figure 15:
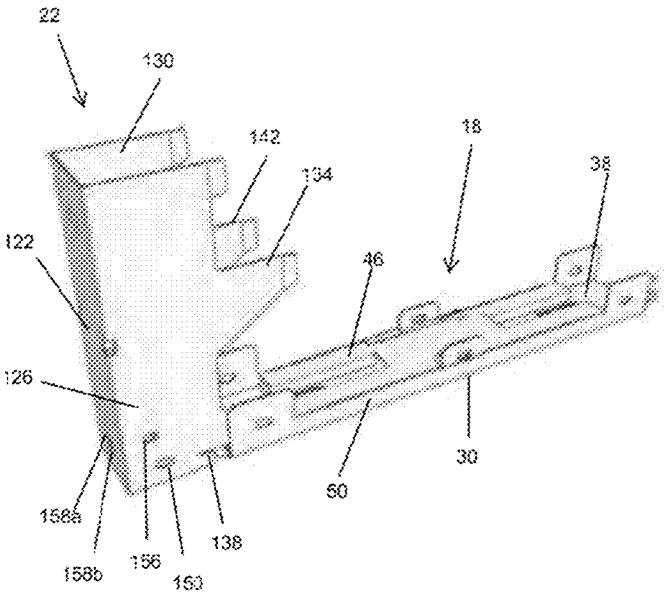
FIG. 15 is a perspective view of the rear vertical tower and the rear wheel brace of FIG. 3 assembled with the base tray of FIG. 2.

With reference to FIG. 3, the rear tower 22 may include a central panel 122, a first side panel 126, and/or a second side panel 130. The rear tower 22 may also include crease lines configured to define which portions of the rear tower 22 may be folded or torn by a user during the assembling process. The first side panel 126 may extend from a first side of the central panel 122, and the second side panel 130 may extend from a second side of the central panel 122 and be located opposite the first side panel 126. The first side panel 126 may include a first arm 134 (e.g., extending from a central portion of the first side panel 126) and a first slit 138 (e.g., defined at a bottom portion of the first side panel 126). The second side panel 130 of the rear tower 22 may include a second arm 142 (e.g., extending from a central portion of the second side panel 130) and a second slit 146 (e.g., defined at a bottom portion of the second side panel 130). During assembly, the first and second slits 138, 146 may slidably receive the base tray 18 (e.g., the bottom layer 30, the intermediate layer 34, and/or the top layer 38) when the rear tower 22 is interlocked with the base tray 18. The first and second slits 138, 146 may therefore allow the rear tower 22 to be firmly, but releasably, connected to the base tray 18 to hold the rear tower 22 in place relative to the base tray 18 (FIG. 15).

With continued reference to FIG. 3, the first side panel 126 of the rear tower 22 may include a first locking aperture 150 extending therethrough and the second side panel may include a second locking aperture 154 extending therethrough. The first and second locking apertures 150, 154 may receive the respective locking clips 92 when the packaging system 10 is assembled. Additionally, the first side panel 126 may include a first side lock 156 and the second side panel 130 may include a second side lock 157. The first and second side locks 156, 157 may, for example, be protrusions that are bent to extend in different directions.

With continued reference to FIG. 3, the central panel 122 of the rear tower 22 may include primary rear lock apertures 158*a*, 158*b*. In the illustrated embodiment, each of the primary rear lock apertures 158*a*, 158*b* has an oblong shape. One or more of the primary rear lock apertures 158*a*, 158*b* may, for example, receive the rear tower locking member 62 of the rear tab 54 to interlock the rear tower 22 with the base tray 18. Once the rear tower 22 is coupled to the base tray 18 by way of the rear tab 54 of the bottom layer 30, the rear tower 22 may then be located at a rear end of the base tray 18.

With continued reference to FIG. 3, in some embodiments the packaging system 10 may include a rear wheel brace 162. The rear wheel brace 162 may include a central panel 166 having secondary rear lock apertures 168*a*, 168*b*, a top panel 170, a bottom panel 174, a first side panel 178, and/or a second side panel 182. In some embodiments, the rear wheel brace 162 may include multiple crease lines configured to define the portions of the rear wheel brace 162 that may be folded or torn by a user when assembling the packaging system 10. The top panel 170 may include a rear wheel slot 172 configured to receive a portion of the rear wheel 20 of the bicycle 14 when the packaging system 10 is assembled. As such, the rear wheel brace 162 may partially surround the rear wheel 20 to support and maintain the position of the bicycle 14 as the packaging system 10 is transported. As illustrated in FIG. 3, the rear wheel slot 172 may have an oblong shape. The top and bottom panels 170, 174 may extend from respective sides of the central panel 166, such that the top and bottom panels 170, 174 are located opposite each other. The first and second side panels 178, 182 may also extend from respective sides of the central panel 166 and be located between the top and bottom panels 170, 174.

Figure 14:
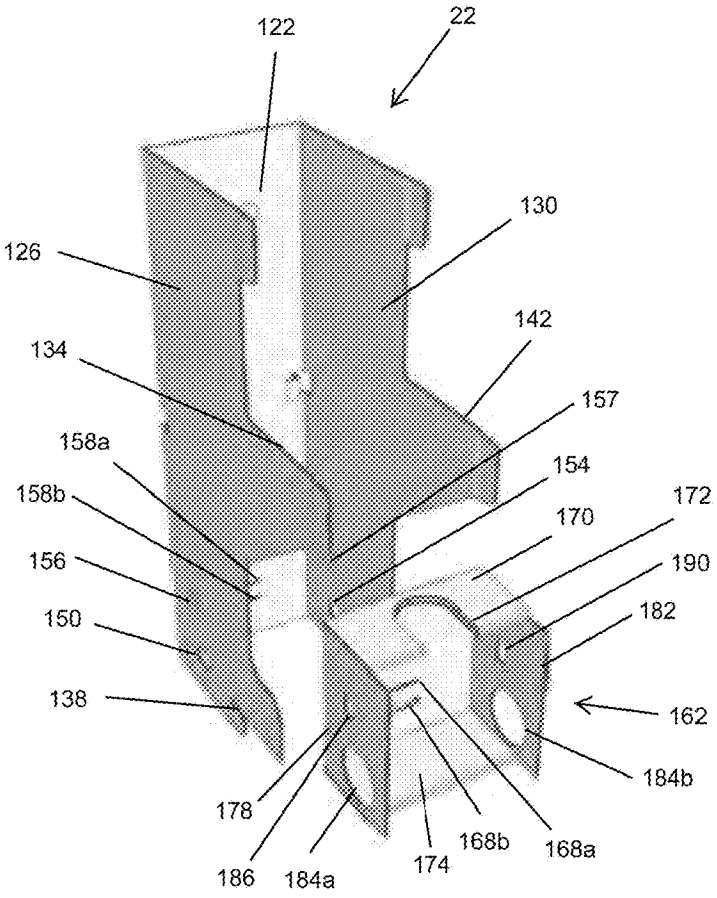
FIG. 14 is a perspective view of the rear vertical tower and the rear wheel brace of FIG. 3 in a folded position.

With continued reference to FIG. 3, and also FIG. 14, the first side panel 178 of the rear wheel brace 162 may include a first side lock aperture 186 and the second side panel 182 may include a second side lock aperture 190. The first and second side lock apertures 186, 190 may be configured to respectively align with the first and second side locks 156, 157 of the rear tower 22. The first and second side locks 156, 157 of the rear tower 22 may be inserted into the first and second side lock apertures 186, 190 to interlock the first and second panels 178, 182 of the rear wheel brace 162 with the first and second side panels 126, 130 of the rear tower 22. The first and second side panels 178, 182 of the rear wheel brace 162 may then be arranged to respectively abut the first and second side panels 126, 130 of the rear tower 22.

In the illustrated embodiment, the secondary rear lock apertures 168*a*, 168*b* are illustrated as two apertures each having an oblong shape. In some embodiments, the secondary rear lock apertures 168*a*, 168*b* may have more or less than two apertures. As the rear wheel brace 162 and the rear tower 22 are interlocked (see FIG. 14), the secondary rear lock apertures 168*a*, 168*b* may align with the primary rear lock apertures 158*a*, 158*b* of the rear tower 22. The rear tab 54 of the base tray 18 may be folded to overlap a portion of the rear tower 22 so that the rear tower locking member 62 may be inserted through the primary and secondary rear lock apertures 158*a*, 158*b*, 168*a*, 168*b* to interlock the base tray 18 to the rear tower 22 and the rear wheel brace 162. As such, the central panel 166 of the rear wheel brace 162 may be arranged to abut the central panel 122 of the rear tower 22, while the bottom panel 174 of the rear wheel brace 162 may abut the top layer 38 of the base tray 18.

With reference to FIG. 3, the first and second side panels 178, 182 of the rear wheel brace 162 may each include a circular hole 184*a*, 184*b* disposed below the first and second side lock apertures 186, 190. Each of the holes 184*a*, 184*b* may be arranged to respectively overlap the first and second locking apertures 150, 154 of the rear tower 22. During assembly, the locking clips 92 may be inserted through the holes 184*a*, 184*b* of the rear wheel brace 162 and the first and second locking apertures 150, 154.

With continued reference to FIG. 3, the rear wheel brace 162 may include a first tab or tabs 202 formed along an edge of the top panel 170 and second tab or tabs 206 formed along an edge of the bottom panel 174. In some embodiments, a first crease line 210 may be located between the central panel 166 and the bottom panel 174 of the rear wheel brace 162. The first crease line 210 may include first slots 214 extending therethrough. A second crease line 218 may be positioned between the central panel 166 and the top panel 170 of the rear wheel brace 162. The second crease line 218 may include slots 222 extending therethrough. The first and second slots 214, 222 may receive the first and second tabs 202, 206 when the rear wheel brace 162 is in a folded position (FIG. 14).

With reference to FIG. 4, the front tower 26 may include a central panel 226, a first side panel 230 having an elongated slot 232, and/or a second side panel 234 having an elongated slot 236. In some embodiments, the front tower 26 may include multiple crease lines configured to define which portions of the front tower 26 may be folded or torn by a user when assembling the packaging system 10. The first side panel 230 may extend from a first side of the central panel 226. The second side panel 234 may extend from a second side of the central panel 226, and may be located opposite the first side panel 230. The first side panel 230 may include a first side arm 246 extending from a top portion of the first side panel 230 and a first slit 270 at a bottom portion of the first side panel 230. The second side panel 234 may include a second side arm 254 that extends from a top portion of the second side panel 234 and a second slit 270 formed along a bottom portion of the second panel 234. The first and second slits 270, 272 may slidably receive the base tray 18 (e.g., the bottom layer 30, the intermediate layer 34, and/or the top layer 38) when front tower 26 is interlocked with the base tray 18. The first and second slits 270, 272 may therefore allow the front tower 26 to be firmly, but releasably, connected to the base tray 18, thereby keeping the front tower 26 in place during transportation of the packaging system 10.

With continued reference to FIG. 4, the first side panel 230 of the front tower 26 may include a first locking aperture 250, while the second side panel 234 may include a second locking aperture 258. The first and second locking apertures 250, 258 may respectively receive the locking clips 92 when the packaging system 10 is fully assembled. The first side panel 230 may further include a first side lock 252 located above the first locking aperture 250 and the second side panel 234 may include a second side lock 260 located above the second locking aperture 258. The first and second side locks 252, 260 may be protrusions that are bent in different directions.

With continued reference to FIG. 4, the central panel 226 of the front tower 26 may include primary front lock apertures 228*a*, 228*b*. In the illustrated embodiment, the central panel 226 includes two primary front lock apertures 228*a*, 228*b* each having an oblong shape. In some embodiments, the central panel 226 may have more or less than two primary front lock apertures 228*a*. The primary front lock apertures 228*a*, 228*b* may receive the front tower locking member 66 of the base tray 18 to interlock the front tower 26 with the base tray 18. As illustrated for example in FIG. 26, the front tower 26 may be located at a front end of the base tray 18 when front tower 26 is interlocked with the base tray 18.

With reference to FIG. 4, in some embodiments the packaging system 10 may include a front wheel brace 274. The front wheel brace 274 may include a central panel 278 having secondary front lock apertures 280*a*, 280*b*, a top panel 282, a bottom panel 286, a first side panel 290, and/or a second side panel 294. In some embodiments, the front wheel brace 274 may include multiple crease lines configured to define the portions of the front wheel brace 274 that may be folded or torn by a user during the assembling process. The top panel 282 may include a front wheel slot 284 configured to receive the front wheel 16 of the bicycle 14 when the packaging system 10 is assembled. The top and bottom panels 282, 286 of the front wheel brace 274 may extend from respective sides of the central panel 278 and may be located opposite each other. The first and second side panels 290, 294 may extend from respective sides of the central panel 278 and between the top and bottom panels 282, 286 of the front wheel brace 274. As such, the front wheel brace 274 may partially surround the rear wheel 20 to support and maintain the position of the bicycle 14, specifically the front wheel 16, when being transported in the packaging system 10.

Figure 25:
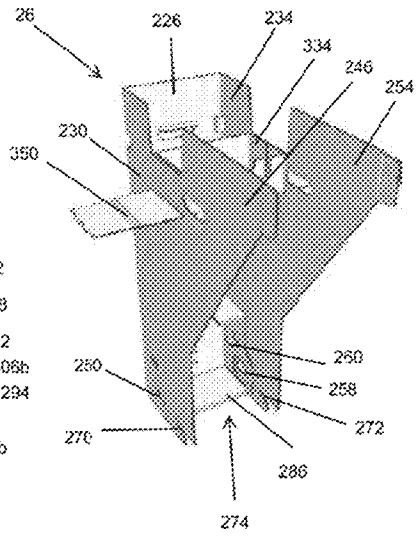
FIG. 25 is a perspective view of the front vertical tower and the front wheel brace of FIG. 4 assembled with the handlebar tray of FIG. 5.
Figure 24:
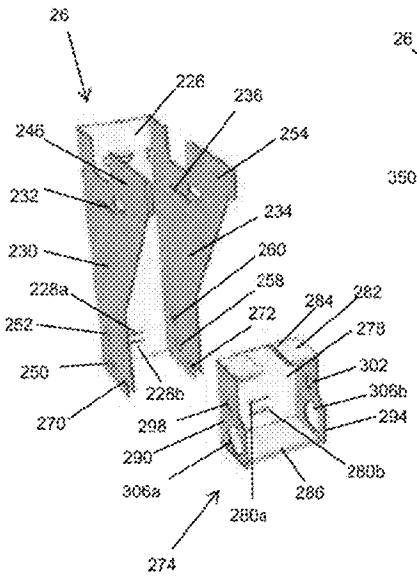
FIG. 24 is a perspective view of the front vertical tower and the front wheel brace of FIG. 4 in a folded position.

With continued reference to FIG. 4, the first side panel 290 of the front wheel brace 274 may include a first side lock aperture 298 extending therethrough. The second side panel 294 of the front wheel brace 274 may include a second side lock aperture 302 extending therethrough. With reference to FIGS. 4, 24, and 25, the first and second side lock apertures 298, 302 may respectively receive the first and second side locks 252, 260 of the front tower 26 to interlock the first side panel 290 of the front wheel brace 274 with the first side panel 230 of the front tower 26 and interlock the second side panel 294 of the front wheel brace 274 to the second side panel 234 of the front tower 26. The front wheel brace 274 may be arranged such that the first and second side panels 230, 234 of the front tower 26 abut the first and second side panels 290, 294 of the front wheel brace 274.

In the illustrated embodiment, the secondary front lock apertures 280*a*, 280*b* of the front wheel brace 274 are two apertures with an oblong shape. In some embodiments, the secondary front lock apertures 280*a*, 280*b* may have more or less than two apertures. The secondary front lock apertures 280*a*, 280*b* may align with the primary front lock apertures 228*a*, 228*b*. As such, the front tab 58 of the base tray 18 may be folded to overlap a portion of the front tower 26 so that the front tower locking member 66 of the base tray 18 may extend through the primary and secondary front lock apertures 228*a*, 228*b*, 280*a*, 280*b* to interlock the base tray 18 to the front tower 26 and the front wheel brace 274. As such, in an assembled state, the central panel 278 of the front wheel brace 274 may be arranged to abut the central panel 226 of the front tower 26, while the bottom panel 286 of the front wheel brace 274 may abut the top layer 38 of the base tray 18.

With continued reference to FIG. 4, the first and second side panels 290, 294 of the front wheel brace 274 may each include a hole 306*a*, 306*b* located below the first and second side lock apertures 298, 302. Each hole 306*a*, 306*b* may be arranged to overlap the first and second locking apertures 250, 258 of the front tower 26 when the front tower 26 and the front wheel brace 274 are interlocked. As such, in the assembled state, the locking clips 92 may be respectively received through each hole 306*a*, 306*b*, as well as the first and second locking apertures 250, 258 of the front tower 26.

With continued reference to FIG. 4, the front wheel brace 274 may include first tabs 310 formed along an edge of the top panel 282 of the front wheel brace 274 and second tabs 314 formed along an edge of the bottom panel 286 of the front wheel brace 274. The crease lines of the front wheel brace 274 may define a first crease line 318 and a second crease line 322. The first crease line 318 may include first slots 326 formed between the central panel 278 and the bottom panel 286 of the front wheel brace 274. The second crease line 322 may include second slots 330 formed between the central panel 278 and the top panel 282 of the front wheel brace 274. The first and second slots 326, 330 may respectively receive the first and second tabs 310, 314 of the front wheel brace 274 when the front wheel brace 274 is in a folded position.

Figure 5:
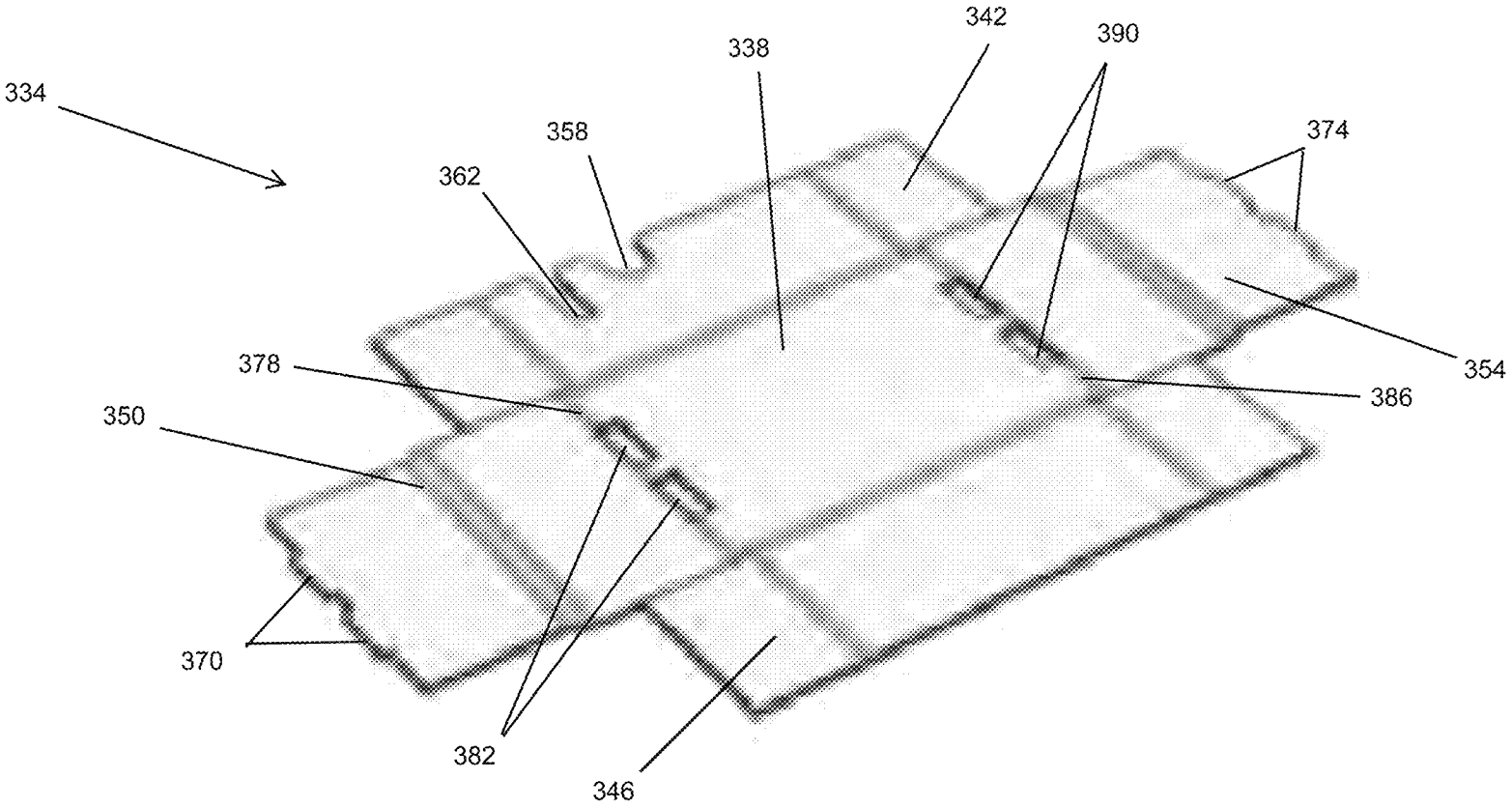
FIG. 5 is a perspective view of a handlebar tray of the packaging system of FIG. 1, in an unfolded configuration.

With reference to FIG. 5, in some embodiments the packaging system 10 may include a handlebar tray 334. The handlebar tray 334 may include a central panel 338, a rear facing panel 342, a front facing panel 346, a first side panel 350, and/or a second side panel 354. In some embodiments, the handlebar tray 334 may include one or more crease lines configured to define which portions of the handlebar tray 334 may be folded or torn by a user when assembling the packaging system 10. In an assembled state, the handlebar tray 334 may be disposed within and interlocked with the front tower 26 to support the handlebar 28 of the bicycle 14. The rear and front facing panels 342, 346 may extend from respective sides of the central panel 338 of the handlebar tray 334, and may be disposed between the rear and front facing panels 342, 346 of the handlebar tray 334. The rear facing panel 342 may include a handlebar receptacle 358 and an auxiliary handlebar receptacle 362, each formed along a top edge of the rear facing panel 342. The handlebar receptacle 358 may receive and support a portion of the handlebar 28 of the bicycle 14. The auxiliary handlebar receptacle 362 may receive an additional component (e.g., a brake lever 366) that may be mounted on the handlebar 28 (FIG. 28).

With continued reference to FIG. 5, the first side panel 350 of the handlebar tray 334 may include first tabs 370 formed along an edge of the first side panel 350. The second side panel 354 of the handlebar tray 334 may include second tabs 374 formed along an edge of the second side panel 354. The crease lines formed on the handlebar tray 334 may include a first crease line 378 having first slots 382 and a second crease line 386 having second slots 390. The first crease line 378 may be formed between the central panel 338 and the first side panel 350 of the handlebar tray 334. The second crease line 386 may be formed between the central panel 338 and the second side panel 354 of the handlebar tray 334. When the handlebar tray 334 is in a folded position (FIG. 28), the first and second slots 382, 390 may respectively receive the first and second tabs 370, 374.

Figure 6:
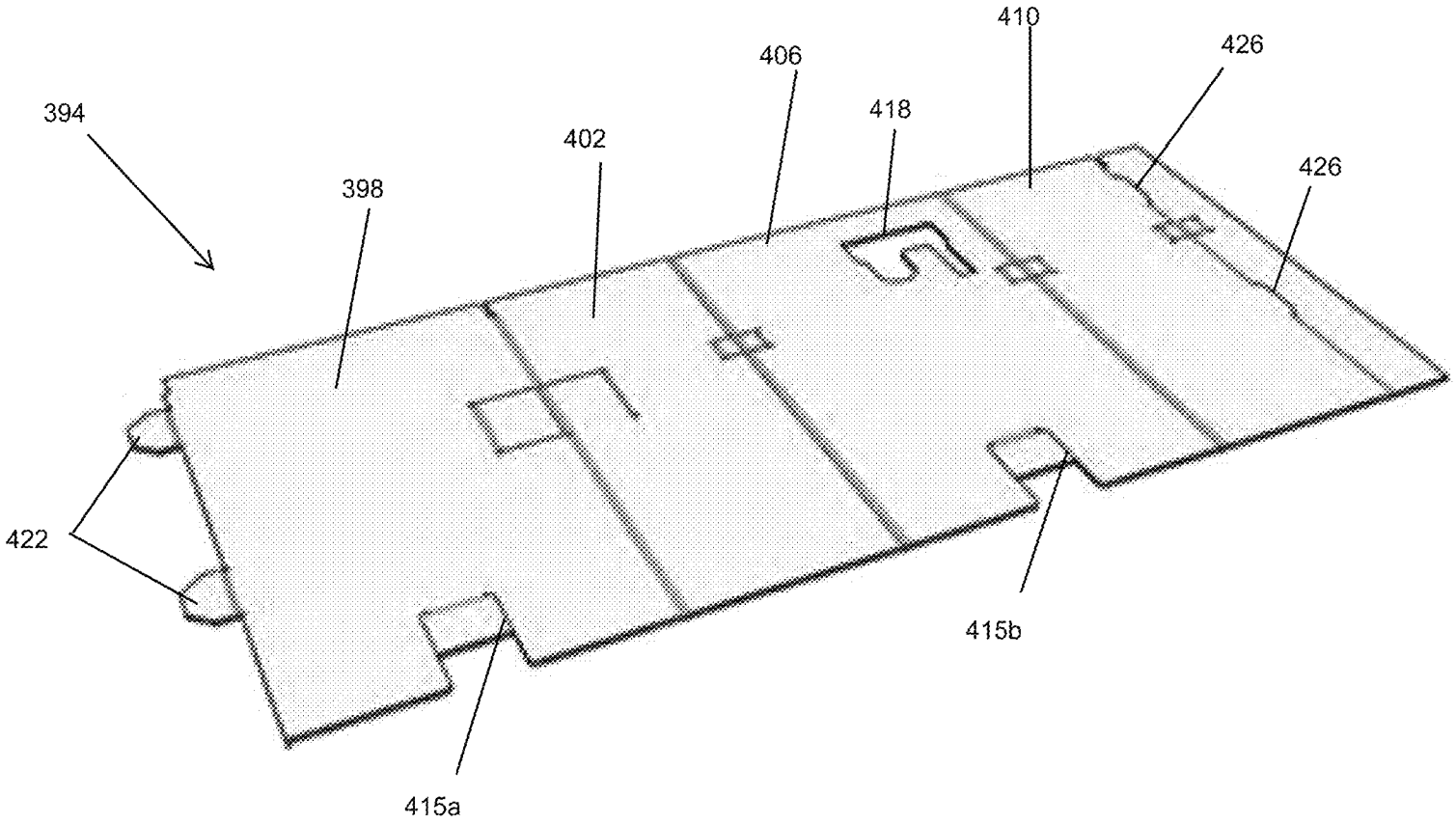
FIG. 6 is a perspective view of a center vertical tower of the packaging system of FIG. 1, in an unfolded configuration.

With reference to FIG. 6, in some embodiments the packaging system 10 may include a center tower 394. The center tower 394 may include a first panel 398, a second panel 402, a third panel 406, a fourth panel 410, and/or multiple crease lines defining portions of the center tower 394 that may be folded or torn by a user when assembling the packaging system 10. The first and fourth panels 398, 410 may serve as end panels of the center tower 394, and the second and third panels 402, 406 may be disposed therebetween. The first and third panels 398, 406 may each include a bike frame receptacle 415*a*, 415*b* configured to receive a portion of the frame of the bicycle 14 when the packaging system 10 is assembled with the bicycle 14. The third panel 406 may also include a handlebar receptacle 418 configured to receive a portion of the handlebar 28.

The first panel 398 of the center tower 394 may include tabs 422 formed along an edge of the first panel 398. When the center tower 394 is in a folded position, the tabs 422 may interlock with flaps 426 formed within the fourth panel 410 of the center tower 394. The flaps 426 may be perforated, so that a user may bend the flaps 426 to form a recess configured to receive the tabs 422. Once the tabs 422 are interlocked with the flaps 426, the center tower 394 may be folded such that the first panel 398 is located opposite the third panel 406 as the second panel 402 is located opposite the fourth panel 410. In some embodiments, the first panel 398 of the center tower 394 may include a tab configured to interlock with a flap formed on the fourth panel 410 of the center tower 394. In other embodiments, the first panel 398 of the center tower 394 may have more than two tabs configured to respectively interlock with one or more flaps formed on the fourth panel 410 of the center tower 394.

Figure 19:
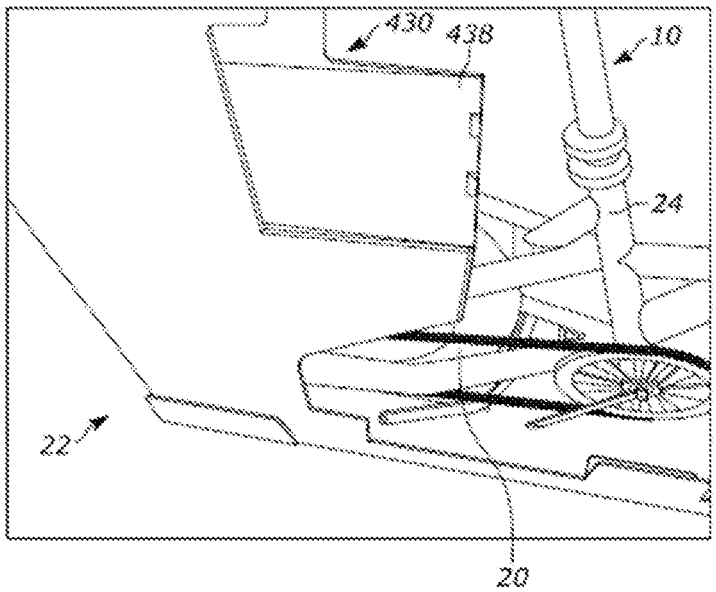
FIG. 19 is a perspective view of the outer tray of FIG. 7, the inner tray of FIG. 8, and the pillow insert of FIG. 9 assembled and coupled to the rear vertical tower of FIG. 3.

With reference to FIGS. 7-9 and 19, in some embodiments the packaging system 10 may include a rear tower insert assembly 430. The rear tower insert assembly 430 may include an inner tray insert 434, an outer tray insert 438, and/or a pillow insert 442. When the inner tray insert 434, the outer tray insert 438, and the pillow insert 442 are folded and assembled together, the rear tower insert assembly 430 may be interlocked with the first and second arms 134, 142 of the rear tower 22 to provide further structural support to the rear tower 22, as illustrated in FIG. 19. When the rear tower insert assembly 430 is interlocked with the rear tower 22, the rear tower insert assembly 430 may be positioned above the rear wheel 20 of the bicycle 14.

Figure 8:
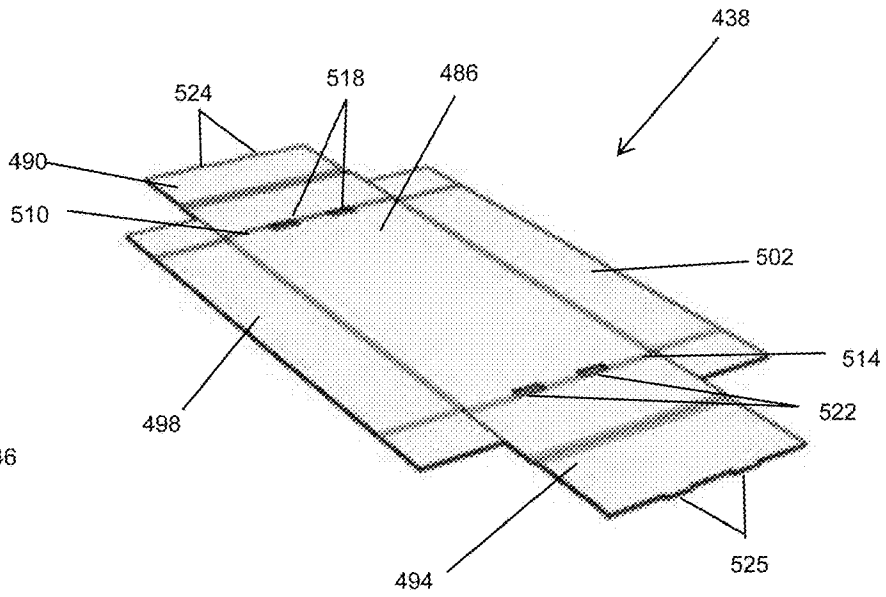
FIG. 8 is a perspective view of an inner tray insert of the packaging system of FIG. 1, in an unfolded configuration.
Figure 7:
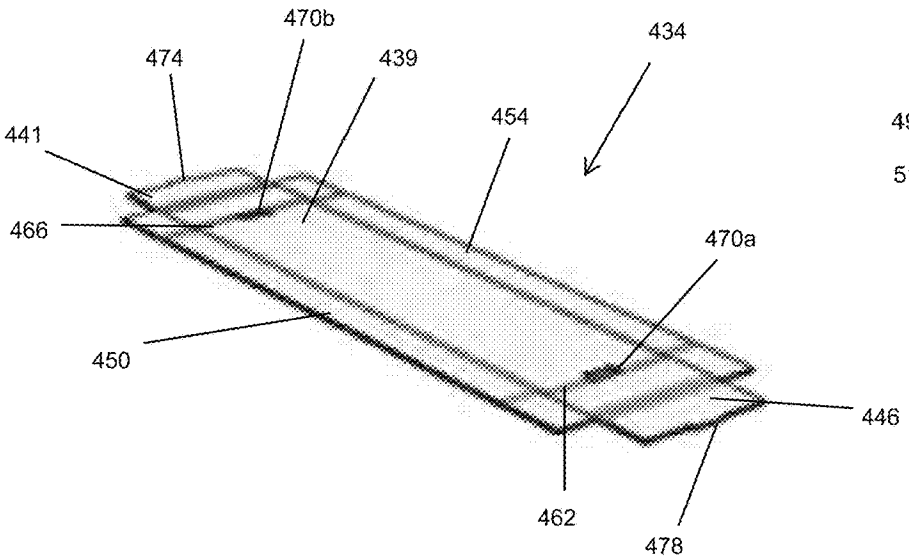
FIG. 7 is a perspective view of an outer tray insert of the packaging system of FIG. 1, in an unfolded configuration.
Figure 9:
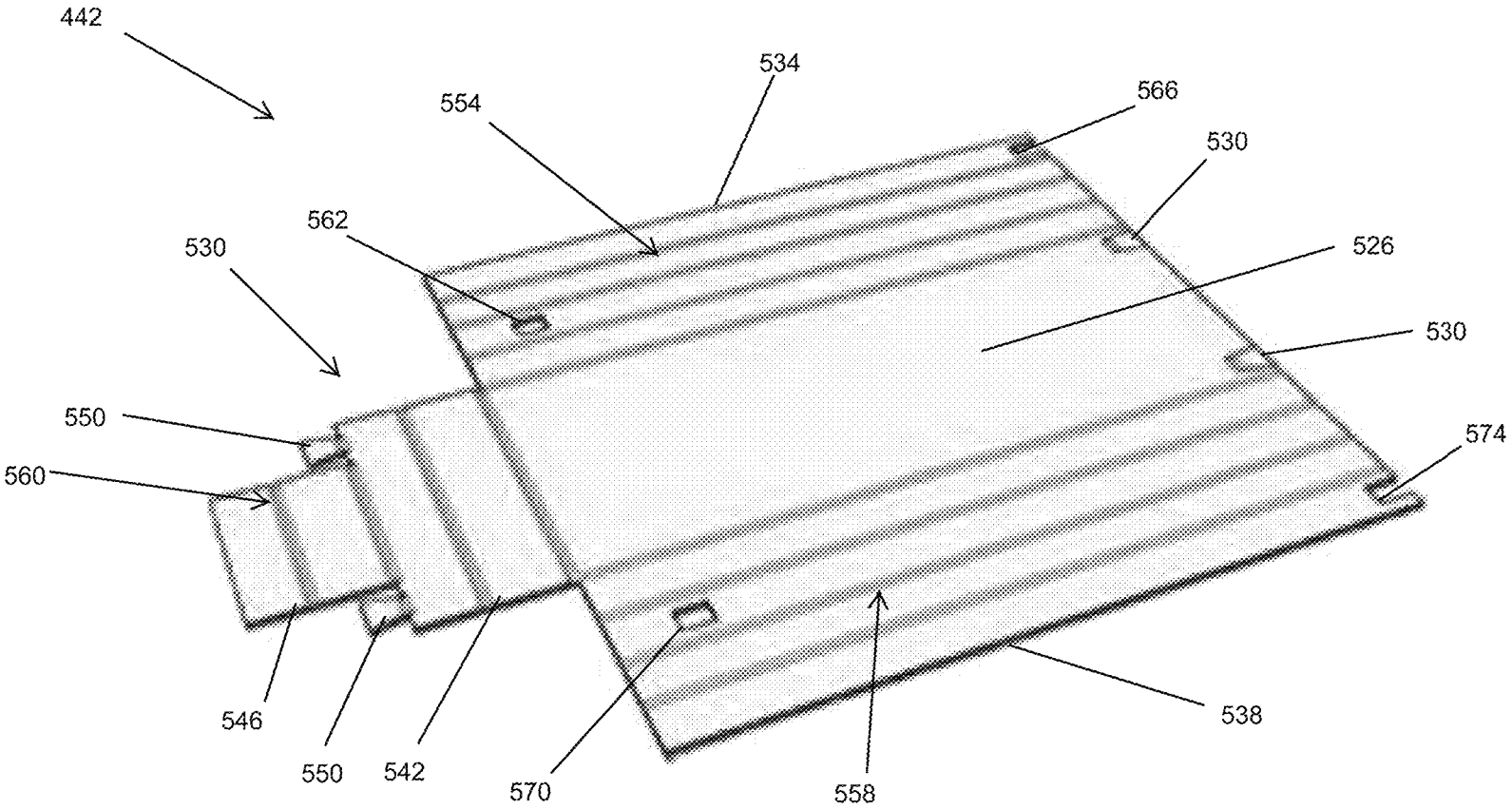
FIG. 9 is a perspective view of a pillow insert of the packaging system of FIG. 1, in an unfolded configuration.

With continued reference to FIGS. 7-9, the inner tray insert 434 of the rear tower insert tower assembly 430 may include a central panel 439, a rear facing panel 441, a front facing panel 446, a first side panel 450, and/or a second side panel 454. The inner tray insert 434 may also include multiple crease lines defining which portions of the inner tray insert 434 may be folded or torn when assembling the packaging system 10. The rear and front facing panels 441, 446 may extend from respective sides of the central panel 439 and be located opposite each other. The first and second side panels 450, 454 may also extend from respective sides of the central panel 438 and be located opposite each other.

The crease lines formed on the inner tray insert 434 may include a first crease line 462 defined between the central panel 438 and the front facing panel 446 of the inner tray insert 434, and a second crease line 466 defined between the central panel 438 and the rear facing panel 441 of the inner tray insert 434. The first crease line 462 may include an aperture 470*a*, and the second crease line 466 may include an aperture 470*b*. The inner tray insert 434 may further include a rear tab 474 formed along an edge of the rear facing panel 442 and a front tab 478 formed along an edge of the front facing panel 446. When the inner tray insert 434 is in a folded position, the rear and front tabs 474, 478 may be respectively received in the inner tray insert apertures 470*a*, 470*b* of the first and second crease lines 462, 466.

With reference to FIG. 8, the outer tray insert 438 may include a central panel 486, a rear facing panel 490, a front facing panel 494, a first side panel 498, and/or a second side panel 502. The outer tray insert 438 may also include multiple crease lines that define portions of the outer tray insert 438 that may be folded or torn when assembling the packaging system 10. The rear and front facing panels 490, 494 of the outer tray insert 438 may extend from respective sides of the central panel 486 of the outer tray insert 438, such that the front facing panel 446 is located opposite the rear facing panel 490. The first and second side panels 498, 502 of the outer tray insert 438 may extend from respective sides of the central panel 486 and between the rear and front facing panels 490, 494.

The crease lines formed on the outer tray insert 438 may include a first crease line 510 defined between the central panel 486 and the rear facing panel 490 of the outer tray insert 438 and a second crease line 514 defined between the central panel 486 and the front facing panel 494 of the outer tray insert 438. The first and second crease lines 510, 514 respectively include first apertures 518 and second apertures 522. The rear facing panel 490 may include first tabs 524 and the front facing panel 494 may include second tabs 525. The first and second tabs 524, 525 may be respectively received within the first and second apertures 519, 522 when the outer tray insert 438 is in a folded position.

With reference to FIG. 9, the pillow insert 442 may include a central panel 526 having apertures 530, a first side panel 534, a second side panel 538, and/or a front facing panel 542. The pillow insert 442 may also include multiple crease lines configured to define which portions of the pillow insert 442 may be folded or torn when assembling the packaging system 10. The crease lines formed on the pillow insert 442 may include a first set of crease lines 554 defined on the first side panel 534 of the pillow insert 442, a second set of crease lines 558 defined on the second side panel 538 of the pillow insert 442, and a third set of crease lines 560 defined on the front facing panel 542 of the pillow insert 442. The front facing panel 542 extends from the central panel 526. The first and second side panels 534, 538 extend from respective sides of the central panel 526 and are located opposite each other. The front facing panel 542 may include a projection 546, and tabs 550.

The first side panel 534 of the pillow insert 442 may include a first aperture 562 formed at a top portion of the first side panel 534 and a second aperture 566 formed at a bottom portion of the first side panel 534. The second side panel 538 of the pillow insert 442 may include a first aperture 570 formed at a top portion of the second side panel 538 and a second aperture 574 formed at a bottom portion of the second side panel 538. As such, the first apertures 562, 570 of the first side panel 534 and the second side panel 548 may respectively receive the tabs 550 of the front facing panel 542 when the pillow insert 442 is in a folded position.

Figure 10:
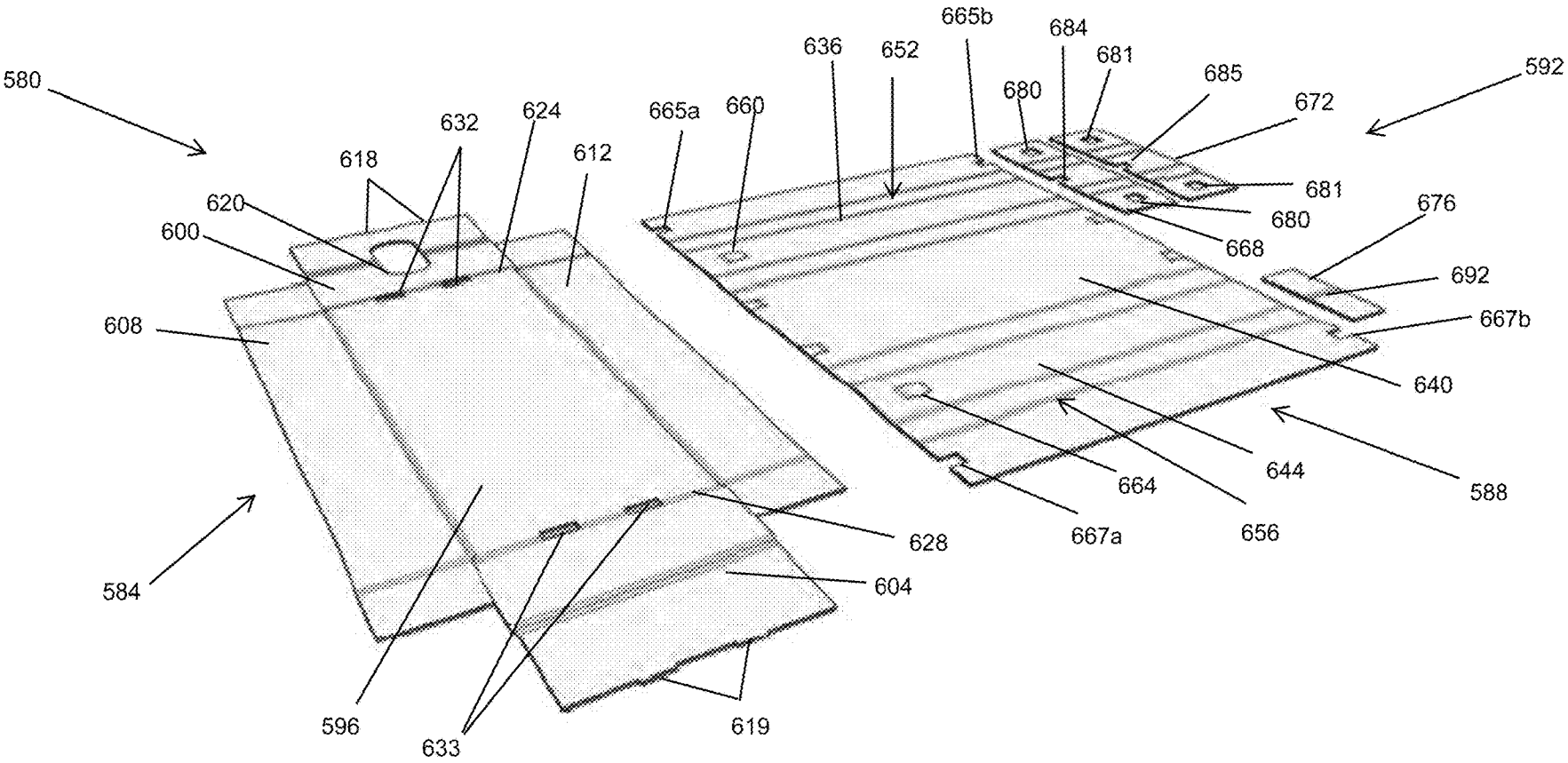
FIG. 10 is a perspective view of a front vertical tower insert assembly of the packaging system of FIG. 1, in an unfolded configuration.
Figure 30:
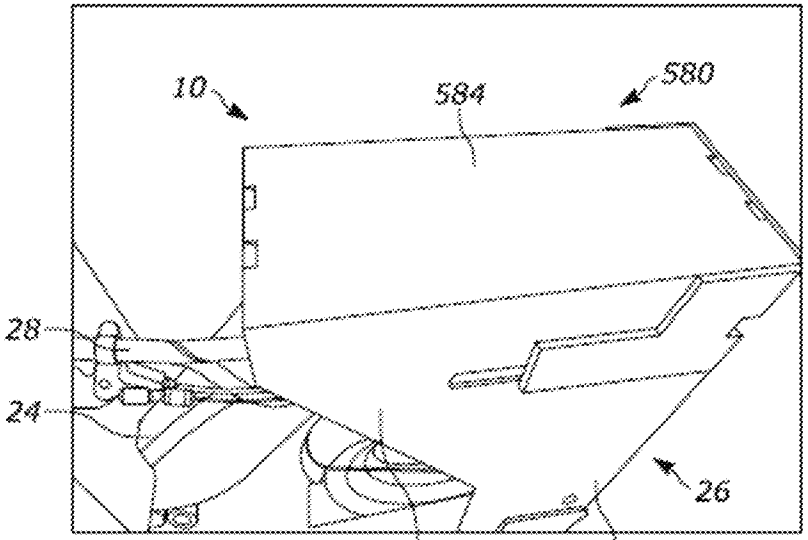
FIG. 30 is a top perspective view of the front vertical tower insert assembly of FIG. 10 coupled to the front vertical tower.

With reference to FIG. 10, in some embodiments the packaging system 10 may include a front tower insert assembly 580. The front tower insert assembly 580 may include a front tower insert tray 584, a front tower pillow insert 588, and/or a plurality of inserts 592. When the front tower insert assembly 580 is assembled, the front tower insert assembly 580 may be interlocked with the first and second side arms 246, 254 of the front tower 26 to add structural support the front tower 26, as illustrated in FIG. 30.

With continued reference to FIG. 10, the front tower insert tray 584 may include a central panel 596, a rear facing panel 600, a front facing panel 604, a first side panel 608, and/or a second side panel 612. The front tower insert tray 584 may also include multiple crease lines configured to define which portions of the front tower insert tray 584 are to be folded or torn when assembling the packaging system 10. The rear facing panel 600 may include first tabs 618 and the front facing panel 604 may include second tabs 619. The rear and front facing panels 600, 604 may extend from respective sides of the central panel 596 and opposite each other. The first and second side panels 608, 612 of the front tower insert tray 584 may also extend from respective sides of the central panel 596 and between the rear and front facing panels 600, 604 of the front tower insert tray 584. The rear facing panel 600 may include a handlebar receptacle 620 configured to receive a portion of the handlebar 28 of the bicycle 14 when the packaging system 10 is assembled.

The crease lines of the front tower insert tray 584 may include a first crease line 624 and a second crease line 628. The first crease line 624 may be defined between the central panel 596 and the rear facing panel 600 of the front tower insert tray 584. The second crease line 628 may be defined between the central panel 596 and the front facing panel 604 of the front tower insert tray 584. The first crease line 624 may include apertures 632, and the second crease line 624 may include apertures 633. The apertures 632, 633 may be configured to respectively receive the first and second tabs 618, 619 of the rear and front facing panels 600, 604 as the front tower insert tray 584 is in a folded position.

With continued reference to FIG. 10, the front tower pillow insert 588 may include a first panel 636, a second panel 640, and/or a third panel 644. The front tower pillow insert 588 may also include multiple crease lines. The first and third panels 636, 644 may serve as end panels of the front tower pillow insert 588, and the second panel 640 may be disposed therebetween. The crease lines formed on the front tower pillow insert 588 may include a first set of crease lines 652 defined on the first panel 636 and a second set of crease lines 656 defined on the third panel 644. As such, the crease lines may define which portions of the front tower pillow insert 588 may be folded or torn when assembling the packaging system 10.

The first panel 636 of front tower pillow insert 588 may include a first insert locking member 660 and the third panel 644 of the front tower pillow insert 588 includes a second insert locking member 664. The first and second insert locking members 660, 664 may be formed as protrusions. In addition, the first panel 636 may include recesses 665*a*, 665*b* disposed at opposite ends of the first panel 636. The third panel 644 may include recesses 667*a*, 667*b* disposed at opposite ends of the second panel 640.

The plurality of inserts 592 may include a first insert 668, a second insert 672, and/or a third insert 676. The first and second inserts 668, 672 may be identical, and therefore the inserts 668, 672 may each have apertures 680, 681 configured to respectively receive the first and second insert locking members 660, 664 of the front tower pillow insert 588. Also, the first and second inserts 668, 672 may respectively have recesses 684, 685 formed along an edge of the first and second inserts 668, 672. The third insert 676 may include a crease line 692 defined at a central portion of the third insert 676.

Figure 11:
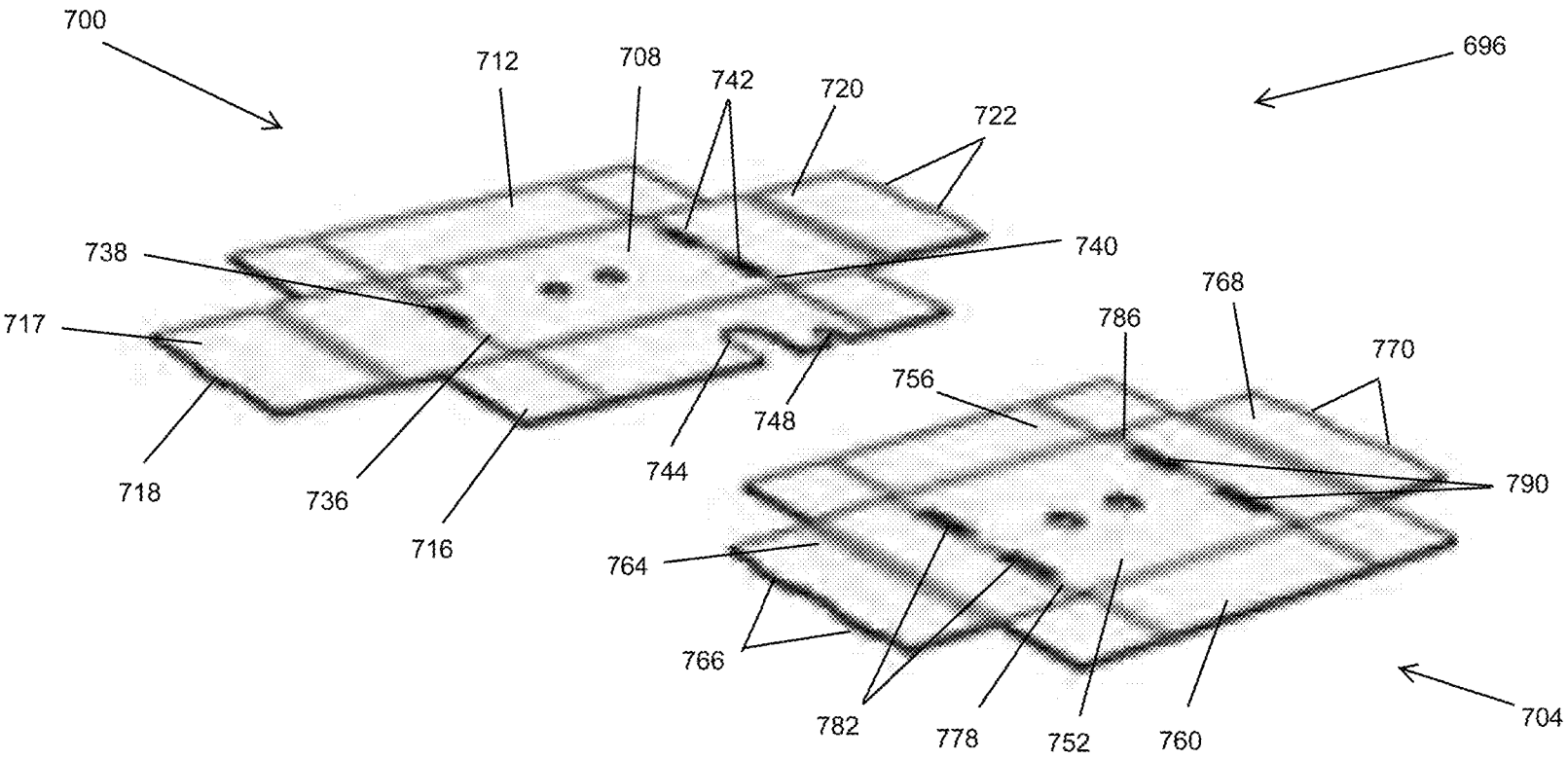
FIG. 11 is a perspective view of a center vertical tower insert assembly of the packaging system of FIG. 1, in an unfolded configuration.

With reference to FIG. 11, in some embodiments the packaging system 10 may include a center tower insert assembly 696. The center tower insert assembly 696 may include a center tower handlebar insert or handlebar insert 700 and a center tower top insert or top insert 704. When assembled, the center tower insert assembly 696 may be inserted within the center tower 394 (e.g., to increase the structural strength of the center tower 394).

With continued reference to FIG. 11, the handlebar insert 700 may include a center panel 708, a rear facing panel 712, a front facing panel 716, a first side panel 717 having a tab 718 formed along an edge of the first side panel 717, and/or a second side panel 720 having tabs 722 formed along an edge of the second side panel 720. The handlebar insert 700 may also include multiple crease lines configured to defined which portions of the handlebar insert 700 may be folded or torn when assembling the packaging system 10. The rear and front facing panels 712, 716 may extend from respective edges of the central panel 708 and may be located opposite each other. The first and second side panels 717, 720 may extend from respective sides of the central panel 708 and may be located opposite each other while being disposed between the rear and front facing panels 712, 716 of the handlebar insert 700.

The crease lines of the handlebar insert 700 may include a first crease line 736 having a slot 738 and a second crease line 740 having slots 742. The first crease line 736 is defined between the central panel 708 and the first side panel 717. The second crease line 740 is defined between the central panel 708 and the second side panel 720. When the handlebar insert 700 is in a folded position, the tab 718, formed on the first side panel 717 of the handlebar insert 700, may be inserted into the slot 738 of the first crease line 736 as the tabs 722 may be inserted into the slots 742.

With continued reference to FIG. 11, the front facing panel 716 of the handlebar insert 700 may include a first receptacle 744 and a second receptacle 748, both formed on an edge of the front facing panel 716. The first receptacle 744 of the front facing panel 716 may be larger than the second receptacle 748, thereby allowing the first receptacle 744 to receive a portion of the handlebar 28 of the bicycle 14. As such, the second receptacle 748 of the front facing panels 716 may receive a portion of an auxiliary component (e.g., brake lever 366) that is mounted on the handlebar 28 of the bicycle 14.

The top insert 704 of the center tower insert assembly 696 may include a central panel 752, a rear facing panel 756, a front facing panel 760, a first side panel 764 having first tabs 766, and/or a second side panel 768 having second tabs 770. The top insert 704 may also include multiple crease lines configured to define the portions of the top insert 304 that may be folded or torn when assembling the packaging system 10. The rear and front facing panels 756, 760 of the top insert 704 may extend from respective edges of the central panel 752 of the top insert 704 and may be located opposite each other. The first and second side panels 764, 768 of the top insert 704 may extend from respective sides of the central panel 752 and may be located opposite each other while being disposed between the rear and front facing panels 756, 760.

The crease lines of the top insert 704 may include a first crease line 778 having first slots 782 and a second crease line 786 having second slots 790. The first crease line 778 of the top insert 704 may be defined between the central panel 752 and the first side panel 764 of the top insert 704. The second crease line 786 of the top insert 704 may be defined between the central panel 752 and the second side panel 768 of the top insert 704. The first and second slots 782, 786 may respectively receive the first and second tabs 766, 770 in a folded position.

Figure 12:
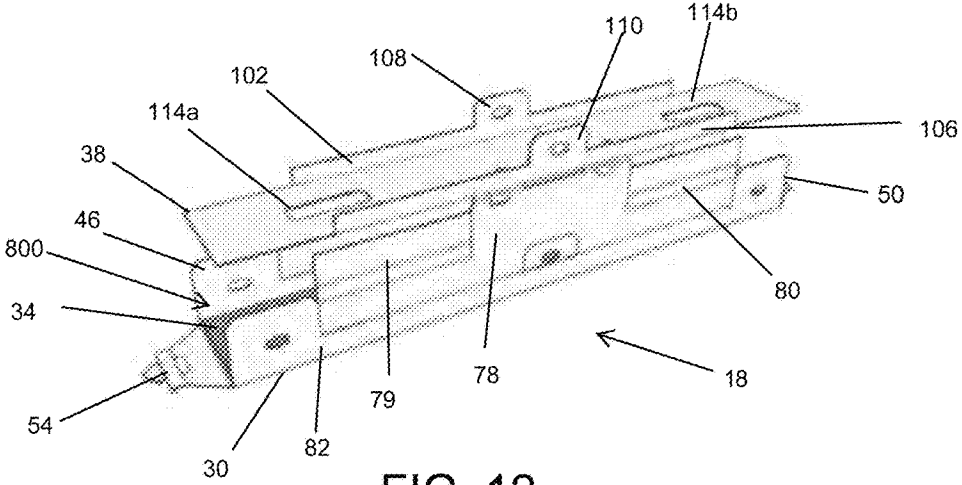
FIG. 12 is a perspective view of the base tray of FIG. 2 in a first folded position.
Figure 13:
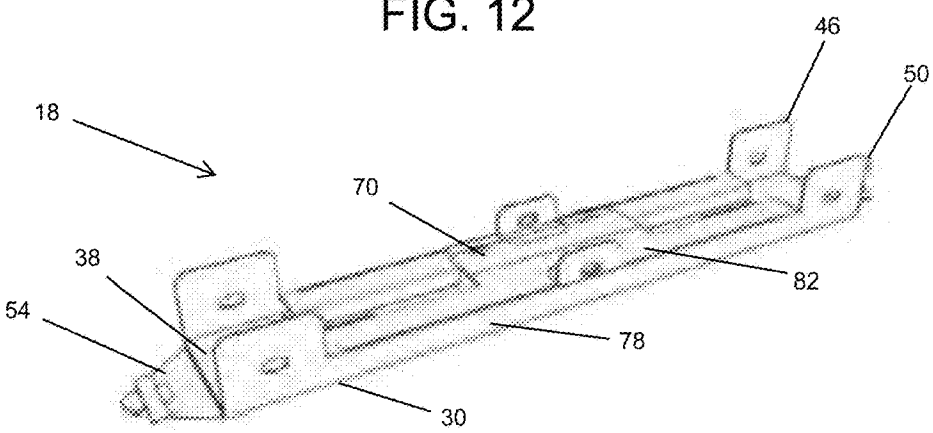
FIG. 13 is a perspective view of the base tray of FIG. 2 in a second folded position.

FIGS. 12 and 13 illustrate one example of a method of assembling the base tray 18 of the packaging system 10. FIG. 12, for example, illustrates the base tray 18 in a first folded position, wherein the bottom layer 30 allows the base tray 18 to receive the intermediate layer 34 and the top layer 38. The first and second side panels 46, 50 of the bottom layer 30 are folded along a crease line defined between the central panel 42 and the first side panel 46 and another crease line define between the central panel 42 and the second side panel 50. As such, the first and second side panels 46, 50 extend upward in a direction perpendicular to the central panel 42 to form a cavity 800 that receives the intermediate layer 34 and the top layer 38. Initially, the intermediate layer 34 of the base tray 18 may be placed within the cavity 800 and may abut the central panel 42 of the bottom layer 30. Afterwards, the top layer 38 may be placed within the cavity 800 as the first and second side panels 102, 106 of the top layer 38 extends upward in a direction perpendicular to the central panel 98 of the top layer 38. The central panel 98 of the top layer 38 may abut the intermediate layer 34.

With reference to FIG. 13, the first side panel 46 may be further folded along the crease line defined between the first central and exterior portions 70, 74 of the first side panel 46. The second side panel 50 may also be folded along the crease line defined between the second central and exterior portions 78, 82. As such, the first and second central portions 70, 78 may be oriented above the top layer 38 and extend parallel to the top layer 38. Each of the rear and front flaps 71, 72, 79, 80 may further be folded as each of the central flaps 73, 78 may remain parallel to the top layer 38. The rear and front flaps 71, 72, 79, 80 may each be folded with respect to itself to form a rectangular shape, thereby defining a recess (not shown).

FIG. 14 illustrates the rear tower 22 and the rear wheel brace 162 in a folded position. The first and second side panels 126, 130 of the rear tower 22 may be folded to be oriented perpendicular to the central panel 122 of the rear tower 22. The rear tower 22 may be folded along the crease line defined between the first side panel 126 and the central panel 122 and another crease line defined between the second side panel 130 and the central panel 122. On the rear wheel brace 162, the top panel 170, the bottom panel 174, the first side panel 178, and the second side panel 182 are folded perpendicularly with respect to the central panel 166. The rear wheel brace 162 may then be interlocked with the rear tower 22 by positioning the rear wheel brace 162 between the first and second side panels 126, 130 of the rear tower 22. The first and second side locks 156, 157 of the rear tower 22 may be bent into the first and second side lock apertures 186, 190 of the rear wheel brace 162.

Figure 16:
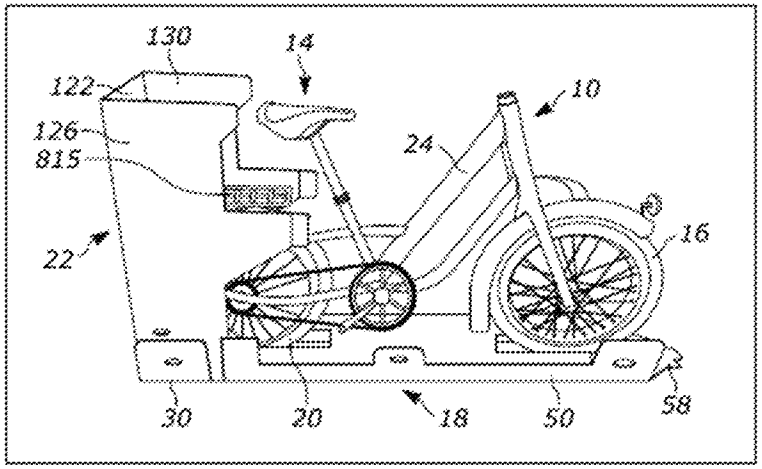
FIG. 16 is a perspective view of the rear vertical tower of FIG. 3, the rear wheel brace of FIG. 3, and the base tray of FIG. 2 assembled with a bicycle.

With reference to FIGS. 15 and 16, the rear tower 22 and the rear wheel brace 162 may together be interlocked to the base tray 18. The rear tower 22 and the rear wheel brace 162 may slide onto the base tray 18 until the first and second slits 138, 146 of the rear tower 22 are received by the base tray 18 such that a portion of the rear tower 22 is located within recesses formed by first and second rear flaps 71, 79 of the base tray 18. As such, the rear tower 22 may overlap the base tray 18, thereby providing structural integrity to the packaging system 10. The rear tab 54 of the bottom layer 30 may then be folded to overlap the rear tower 22, so that the rear tower locking member 62 may be inserted through the primary and secondary rear lock apertures 158*a*, 158*b*, 168*a*, 168*b* of the rear tower 22 and the rear wheel brace 162. Interlocking the rear tower 22 to the base tray 18 in such a manner may prevent the rear tower 22 from sliding back and forth relative to the base tray 18. After attaching the base tray 18 to the rear tower 22 and the rear wheel brace 162, the bicycle 14 may be placed onto the base tray 18 such that a portion of the rear wheel 20 of the bicycle is located within the rear wheel slot 172 of the rear wheel brace 162, as well as in the slots 94*a* of the intermediate layer 34 and the slot 114*a* of the top layer 38.

Figure 17:
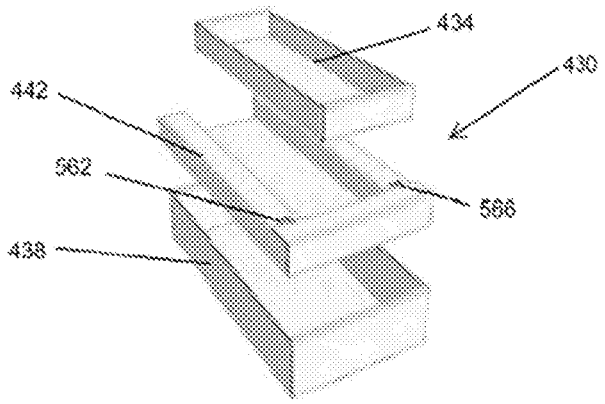
FIG. 17 is a perspective view of the outer tray of FIG. 7, the inner tray of FIG. 8, and the pillow insert of FIG. 9 is a folded position.
Figure 18:
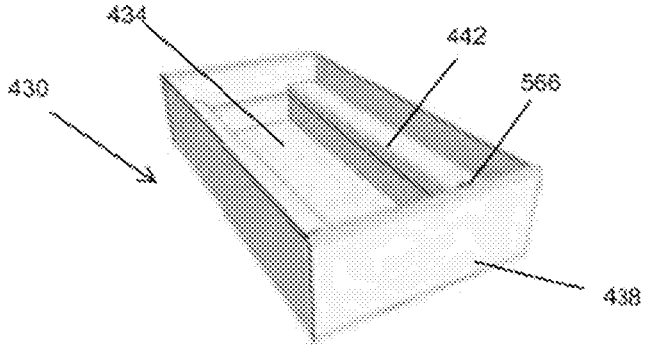
FIG. 18 is a perspective view of the outer tray of FIG. 7, the inner tray of FIG. 8, and the pillow insert of FIG. 9 assembled.

With reference to FIGS. 17-19, the inner tray insert 434, the outer tray insert 438, and the pillow insert 442 may each be folded to form a box-like structure. For example, the first side panel 534 may be folded along the first set of crease lines 554 to form a rectangular shape such that the first aperture 562 is facing upward. The second side panel 538 may be folded along the second set of crease lines 558 to form a rectangular shape such that the second aperture 566 is also facing upward. The front facing panel 542 may be folded along the third set of crease lines 560 to form a rectangular prism shape. When folding the front facing panel 542, the tabs 550 may be inserted into the first and second apertures 562, 566 to couple the front facing panel 542 to the first and second side panels 534, 538, and maintain the form of the front facing panel 542.

Once folded, the pillow insert 442 may be positioned inside the outer tray insert 438. The inner tray insert 434 may then be positioned inside the pillow insert 442. The rear tower insert assembly 430 may be placed over the rear wheel 20 of the bicycle 14, and between the first and second arms 134, 142 of the rear tower 22. The first and second arms 134, 142 of the rear tower 22 may each include a tab 804, 808 (FIG. 3) configured to be inserted into openings (not shown) respectively formed between the front facing panel 494, the first side panel 498, and the second side panel 502 of the outer tray insert 438, to interlock the rear tower insert assembly 430 to the rear tower 22. As the rear tower insert assembly 430 is attached to the rear tower 22, the rear tower insert tower assembly 430 may engage a portion of a rear rack 815 (FIG. 16) provided above the rear wheel 20.

Figure 20:
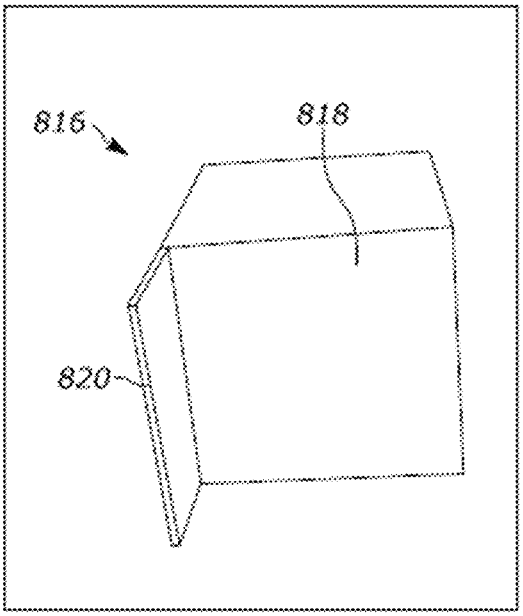
FIG. 20 is a perspective view of a spacer box.
Figure 21:
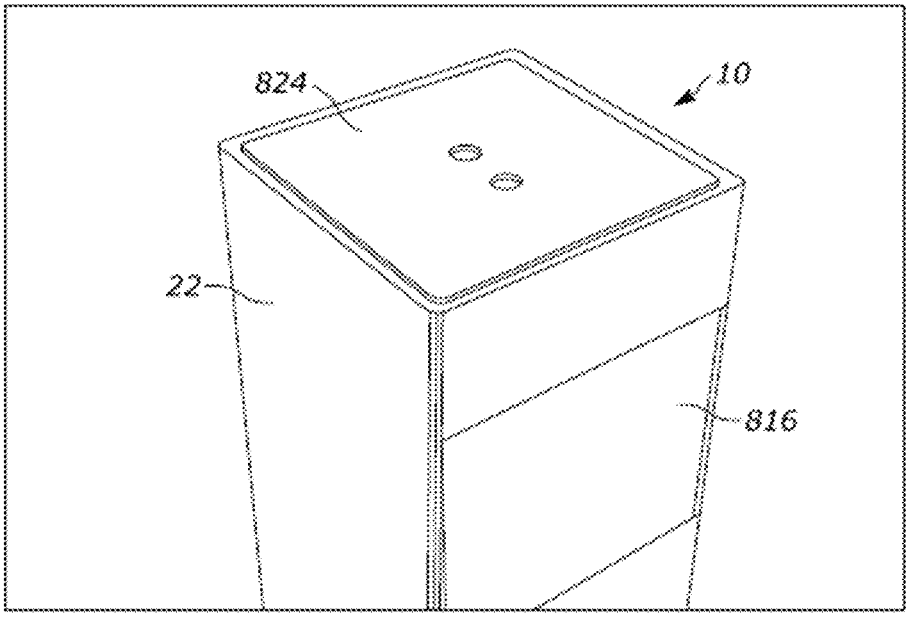
FIG. 21 is a perspective view of the spacer box of FIG. 20 and a small parts box coupled to the rear vertical tower of FIG. 3.

With reference to FIGS. 20 and 21, the packaging system 10 may include a spacer box 816 having a body 818 and a flap 820 extending from the body 818 in a direction perpendicular to the body 818. The spacer box 816 may be positioned above the rear tower insert assembly 430 by inserting the flap 820 of the spacer box 816 behind the rear tower insert assembly 430.

With continued reference to FIG. 21, the packaging system 10 may include a small parts box 824. The small parts box 824 may be placed on top of the body 818 of the spacer box 816. The small parts box 824 may house small bicycle components or tool components, or other types of components. The small parts box 824 may be coupled to the rear tower 22 by inserting tabs 828, 829 (FIG. 3) formed on the rear tower 22 into openings (not shown) formed along sides of the small parts box 824.

Figure 22:
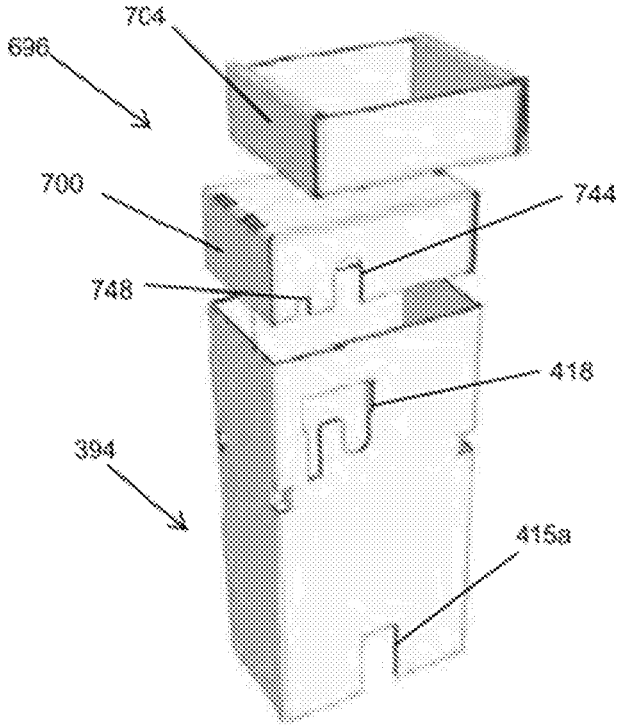
FIG. 22 is a perspective view of the center vertical tower of FIG. 6 and the center tower insert assembly of FIG. 11 in a folded position.

With reference to FIG. 22, the center tower 394 may be folded along the crease lines 414 to form a rectangular shape. For example, the center tower 394 may be folded along the crease lines 414 that defines each panel 398, 402, 406, 410 of the center tower 394. To maintain the folded position of the center tower 394, the tabs 422 of the first panel 398 may interlock with the flaps 426 of the fourth panel 410. The handlebar insert 700 and the top insert 704 of the center tower insert assembly 696 may also be folded along the crease lines 724, 774 to form a box-like structure. The handlebar insert 700 may be placed first in the center tower 394, while the top insert 704 may be placed second into the center tower 394. As the handlebar insert 700 is placed inside the center tower 394, a handlebar recess 830 (FIG. 27) may be formed by the first receptacle 744 of the handlebar insert 700 and the handlebar receptacle 418 of the center tower 394. The first receptacle 744 and the handlebar receptacle 418 may then be used to secure a portion of the handlebar 28.

Figure 23:
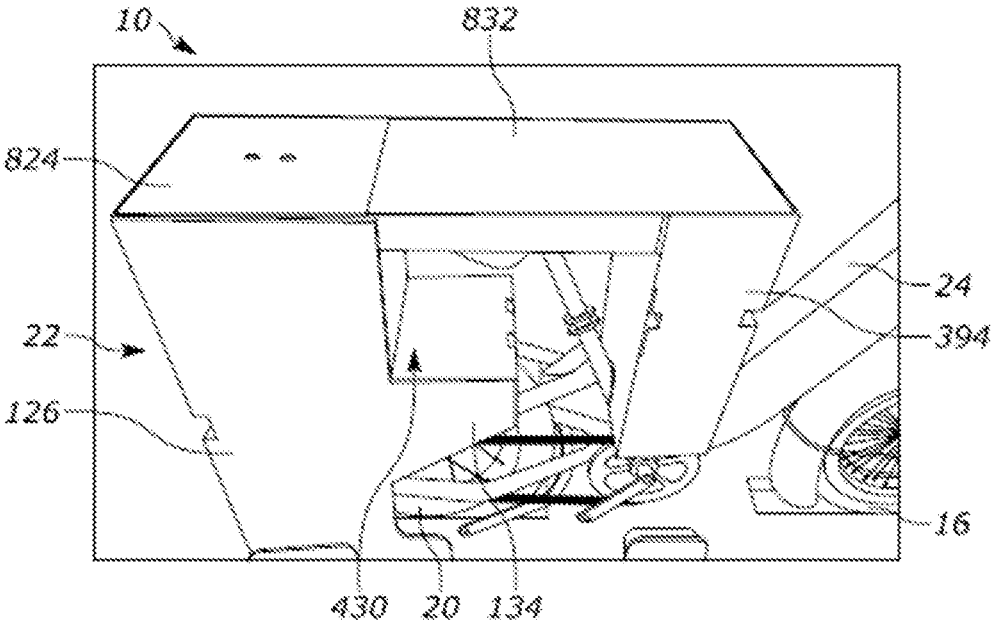
FIG. 23 is a perspective view of the center vertical tower of FIG. 6 coupled to the rear vertical tower of FIG. 3.

With reference to FIG. 23, the center tower 394 may be coupled to the rear tower 22 by a bridge piece 832. One side of the bridge piece 832 may be coupled to (e.g., rest against or interlock with) the small parts box 824, and the other side of the bridge piece 832 may be coupled to the center tower 394. As such, the bridge piece 832 may extend between the center tower 394 and the rear tower 22. Moreover, the center tower 394 may engage the frame 24 of the bicycle 14 and may be spaced above the base tray 18. In some embodiments, the center tower 394 may be provided to reduce or eliminate any movement of the bicycle 14.

With reference to FIGS. 24 and 25, the first and second side panels 230, 234 of the front tower 26 may be folded along the crease lines such that the first and second side panels 230, 234 are oriented perpendicular to the central panel 226 of the front tower 26. The top panel 282, the bottom panel 286, the first side panel 290, and the second side panel 294 of the front wheel brace 274 may each be folded perpendicularly along respective crease lines with respect to the central panel 278 of the front wheel brace 274. After folding the front tower 26 and the front wheel brace 274, the front wheel brace 274 may be positioned between the first and second side panels 230, 234 of the front tower 26. The first and second side locks 252, 260 of the front tower 26 may then be pivoted into the first and second side lock apertures 298, 302 of the front wheel brace 274 to interlock the front tower 26 with the front wheel brace 274. Further, the handlebar tray 334 may be coupled to the front tower 26 by respectively inserting the first and second side panels 350, 354 of the handlebar tray 334 into the elongated slots 232, 236 formed on the first and second side panels 230, 234 of the front tower 26. Each of the first and second side panels 350, 354 may be folded over the front tower 26 so that the first and second tabs 370 may be inserted into the first and second slots 386, 390 to further secure the handlebar tray 334 to the front tower 26.

Figure 26:
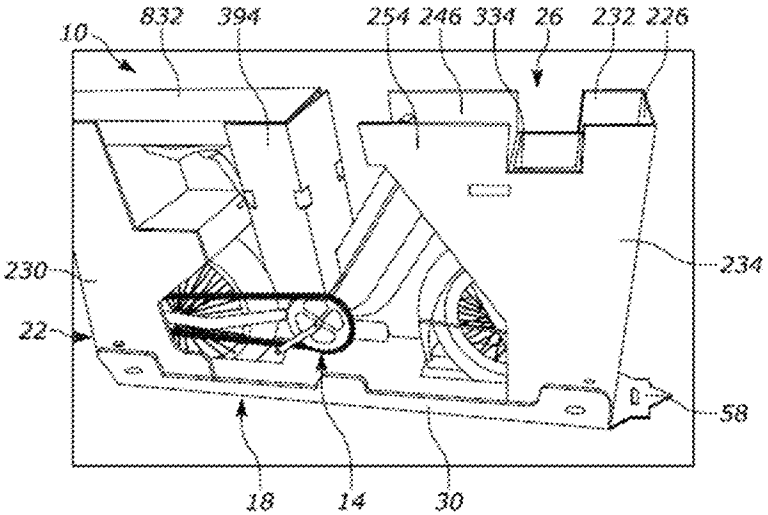
FIG. 26 is a perspective view of the front vertical tower and the front wheel brace of FIG. 4 assembled with the base tray of FIG. 2.

With reference to FIGS. 25 and 26, the front tower 26 and the front wheel brace 274 may slide onto the base tray 18 until the first and second slits 270, 272, formed on the first and second side panels 230, 234 of the front tower 26, are received by the base tray 18 (e.g., such that a portion of the front tower 26 is received within the recesses of the rear and front flaps 72, 80). The front tower 26 may be arranged to overlap the base tray 18 to provide structural integrity along a front end of the packaging system 10. To further couple the front tower 26 and the front wheel brace 274 to the base tray 18, the front tab 58 of the base tray 18 may be folded to overlap the front tower 26. The front tower locking member of the front tab 58 may then be inserted into the primary and secondary front lock apertures 228*a*, 228*b*, 280*a*, 280*b* of the front tower 26 and the front wheel brace 274. As such, the front wheel slot 284 of the front wheel brace 274 may receive a portion of the front wheel 16. With the front tower 26 interlocked with the base tray 18, the front tower 26 may be prevented from sliding back and forth relative to the base tray 18.

With reference to FIGS. 27 and 28, the handlebar 28 of the bicycle 14 may be attached to the packaging system 10, once the rear tower 22, the front tower 26, and the center tower 394 are assembled with the base tray 18. For example, a first end of the handlebar 28 may be inserted into the handlebar recess 830 formed within the center tower 394. A second end of the handlebar 28, opposite the first end, may be received within the handlebar receptacle 358 of the handlebar tray 334. The brake lever 366 may be received within the auxiliary handlebar receptacle 362 of the handlebar tray 334. The packaging system 10 may further include a handlebar cap 844 (FIG. 28) having a recess 848 formed along an edge of the handlebar cap 844. The handlebar cap 844 may be received by the handlebar tray 334 to cover and secure the second end of the handlebar 28 to the handlebar tray 334. When coupling the handlebar tray 334 and the handlebar cap 844, the recess 848 of the handlebar cap 844 may receive the second end of the handlebar 28. The handlebar cap 844 may be smaller than the handlebar tray 334, thereby allowing the handlebar cap 844 to be inserted within an interior volume defined by the central panel 338, the rear and front facing panels 342, 346, and the first and second side panels 350, 354 of the handlebar tray 334.

Figure 29:
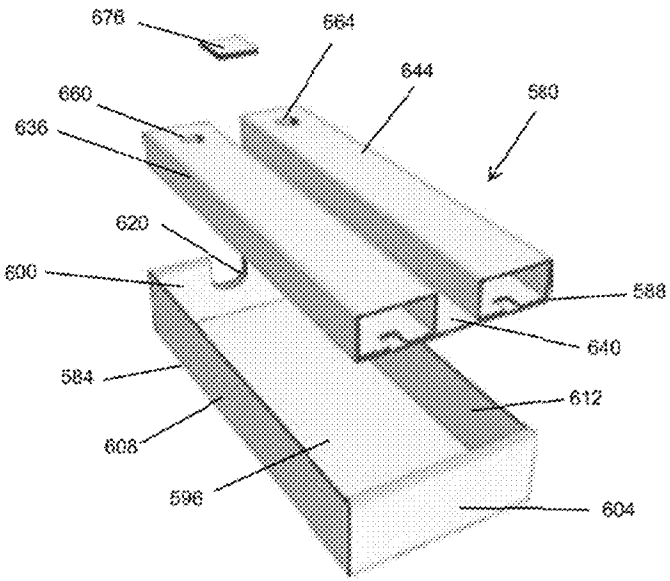
FIG. 29 is a perspective view of the front tower insert assembly of FIG. 10 in a folded position.

With reference to FIGS. 29 and 30, the front tower insert tray 584 may be folded along crease lines to form a rectangular shape. The front tower pillow insert 588 may be folded along the crease lines 646. The first panel 636 may be folded within itself along the first set of crease lines 652 to form a rectangular shape. The third panel 644 may be folded within itself along the second set of crease lines 656 to form a rectangular shape. In a folded position, the front tower insert tray 584 may serve as a base, while the front tower pillow insert 588 may be arranged inside the front tower insert tray 584. The first and second inserts 668, 672 of the plurality of inserts 592 may be folded to form a rectangular form and may be positioned inside of the front tower pillow insert 588. Each of the apertures 680, 681, provided on the first and second inserts 668, 672, may receive the first and second insert locking members 660, 664 of the front tower insert tray 584 to be locked in place.

Once the front tower insert assembly 580 is assembled, the front tower insert assembly 580 may be coupled to a top portion of the front tower 26 with the handlebar receptacle 620 of the front tower insert tray 584 facing downward. For example, the front tower insert assembly 580 may be arranged between the first and second arms 246, 254 of the front tower 26. The front tower insert tray 584 may include openings (not shown) configured to receive tabs 850, 851 (FIG. 4) formed on the first and second arms of the front tower 26, to couple the front tower insert assembly 580 to the front tower 26. In some embodiments, the rear insert tower assembly 430, the front tower insert assembly 580, and the center tower insert assembly 696 may each define engagement points with the bicycle 14 that isolate the movement of bicycle 14, thereby preventing the bicycle 14 from moving forward, backwards, upwards, downwards, or side-to-side when being transported within the packaging system 10.

Figure 31:
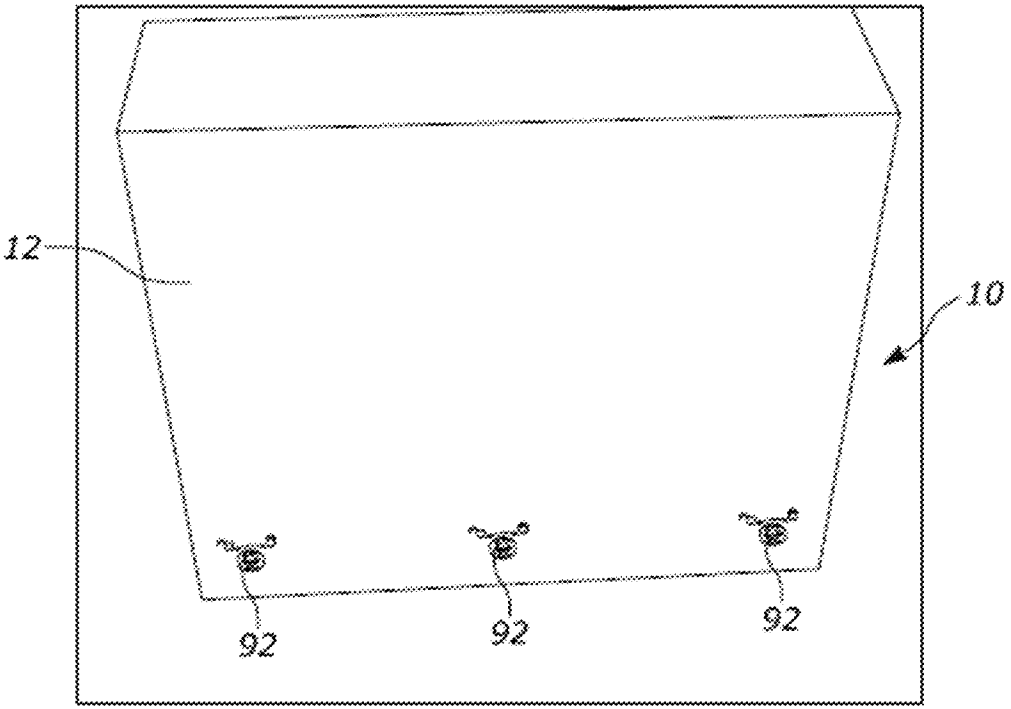
FIG. 31 is a front view of the packaging system of FIG. 1 with locking clips, the packaging system in a closed configuration.
Figure 32:
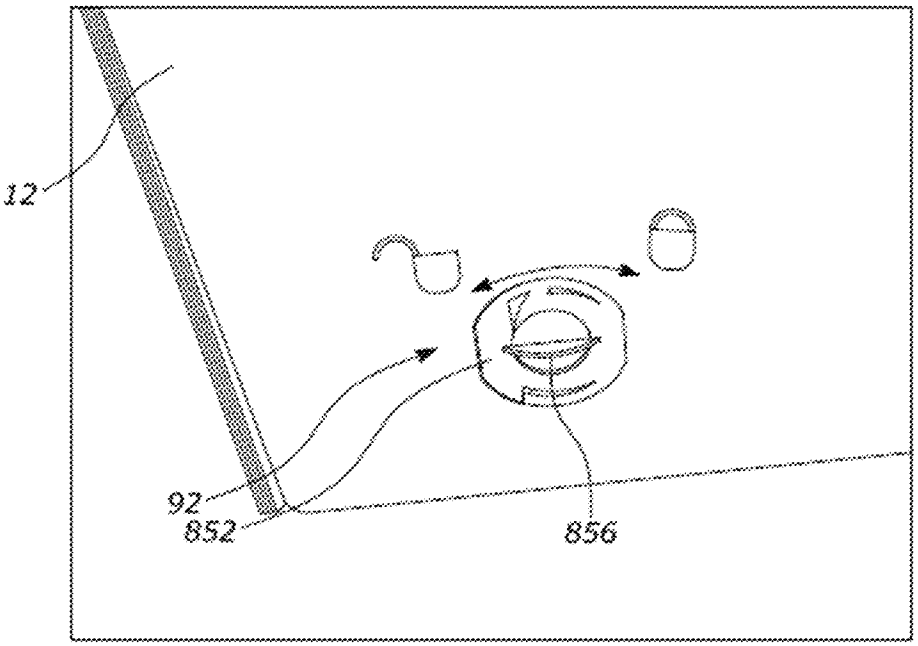
FIG. 32 is an enlarged view of the packaging system of FIG. 1 with a locking clip.

With reference to FIGS. 31 and 32, the outer carton 12 may surround the bicycle 14 as the bicycle 14 is being supported by the base tray 18, the rear tower 22, the front tower 26, and/or the center tower 394. Multiple locking clips 92 may be provided to securely couple the outer carton 12 to the base tray 18, the rear tower 22, and/or the front tower 26. Each locking clip 92 may include a disc portion 852 with a tab 856 configured to be grasped by a user. Each locking clip 92 may be inserted through the locking apertures 86*a*, 86*b* of the base tray 18, the first and second locking apertures 150, 154 of the rear tower 22, and/or the first and second locking apertures 250, 258 of the front tower 26. Each of the locking clips 92 may be rotated, for example, between a locked state and an unlocked state. In the locked state, each locking clip 92 may be rotated for example in a first rotational direction to lock the outer carton 12, the base tray 18, the rear tower 22 and the front tower 26 together, thereby inhibiting movement of the outer carton 12 relative to the base tray 18, the rear tower 22, and the front tower 26. In the unlocked state, each locking clip 92 may be rotated in a second rotational direction, opposite the first rotational direction, to permit the removal of the outer carton 12. Once the locking clips 92 are in the unlocked state, the outer carton 12 may be removed from the packaging system 10, for example by lifting the outer carton 12 until the bicycle 14 is no longer under the outer carton 12.

The packaging system 10 described above may be modified, and the components thereof may be combined in different manners. For example, in some embodiments, the packaging system 10 may include the base tray 18 and the rear tower 22, but the packaging system 10 may not include the front tower 26. In other embodiments, the packaging system 10 may include the base tray 18 and the front tower 26, but the packaging system 10 may not include the rear tower 22. In some embodiments, the packaging system 10 may not include the center tower 394, and/or the bridge piece 832 interconnecting the center tower 394 to the rear tower 22. The packaging system 10 may also not include the rear tower insert assembly 430, the front tower insert assembly 580, and/or the center tower insert assembly 696. Additionally, in some embodiments, the packaging system 10 may not include locking clips 92, or may include other numbers and arrangements of locking clips 92 than that illustrated. Additionally, the number and arrangement of flaps, holes, apertures, slits, and creases on each of the components of the packaging system 10 described above may be varied, for example depending on the size of the bicycle 14. The outer carton 12 may also slide horizontally over the base tray 18, rather than vertically down over the base tray 18, and/or may have a shape and configuration other than that illustrated. In some embodiments, the packaging system 10 may not include the outer carton 12, and/or may include more than one outer carton 12 or outer packaging component.

Additionally, in some embodiments the packaging system 10 may be configured to hold the bicycle 14 in a stationary and upright position to enable a consumer to conveniently assemble the bicycle 14. The packaging system 10 may also, or alternatively, enable the consumer to roll the bicycle 14 off the packaging system 10 (as opposed for example to pulling the bicycle 14 up and out of a box). This capability of being able to roll the bicycle 14 off of the packaging system 10 may be advantageous, particularly for a heavier bicycle 14.

Various features and advantages of the disclosure are set forth in the following claims.

What is claimed is:

1. A packaging system for a bicycle, the packaging system comprising:

a base tray including a central panel;

a first tab extending away from a first longitudinal end of the central panel in a first direction, a second tab extending away from a second longitudinal end of the central panel along a second direction that is opposite to the first direction, a first side extending between the first tab and the second tab, and a second side extending between the first tab and the second tab and located opposite the first side, the first side and the second side defining a length of the base tray;

a first vertical tower having a first aperture configured to receive the first tab of the base tray to interlock the first vertical tower to the base tray at the first end;

a second vertical tower having a second aperture configured to receive the second tab of the base tray to interlock the second vertical tower to the base tray at the second end; and an outer carton configured to surround and interlock with the base tray, the first vertical tower, and the second vertical tower.

2. The packaging system of claim 1, wherein the first vertical tower includes multiple slits formed at a bottom portion of the first vertical tower, wherein the slits are configured to be slidably received by the base tray at the first end of the base tray.

3. The packaging system of claim 2, wherein the slits are first slits, wherein the second vertical tower includes multiple second slits formed at a bottom portion of the second vertical tower, wherein the second slits are configured to be slidably received by the base tray at the second end of the base tray.

4. The packaging system of claim 1, further comprising:

a rear wheel brace having a rear wheel slot configured to receive a rear wheel of the bicycle, and rear lock apertures, and a front wheel brace having a front wheel slot configured to receive a front wheel of the bicycle, and front lock apertures.

5. The packaging system of claim 4, wherein the first vertical tower includes first side locking protrusions, wherein the rear wheel brace is configured to abut the first vertical tower, and wherein the rear lock apertures are configured to respectively receive the first side locking protrusions to interlock the rear wheel brace with the first vertical tower.

6. The packaging system of claim 4, wherein the second vertical tower includes second side locking protrusions, wherein the front wheel brace is configured to abut the second vertical tower, and wherein the front lock apertures are configured to respectively receive the second side locking protrusions to interlock the front wheel brace with the second vertical tower.

7. The packaging system of claim 1, further comprising:

a third vertical tower configured to be positioned between the first vertical tower and the second vertical tower, and configured to be spaced above the base tray, the third vertical tower configured to engage a frame of the bicycle, and a bridge piece configured to be coupled to the first vertical tower and the third vertical tower, thereby interconnecting the first vertical tower with the third vertical tower.

8. The packaging system of claim 7, further comprising multiple inserts configured to be positioned within the first vertical tower, the second vertical tower, and the third vertical tower.

9. The packaging system of claim 1, wherein the second vertical tower includes slots formed along a top portion of the second vertical tower, wherein the packaging system further includes a handlebar tray having a first side panel and a second side panel configured to be respectively received within the slots formed, thereby coupling the handlebar tray to the second vertical tower.

10. A base tray configured to be coupled to a first vertical tower and a second vertical tower, wherein the base tray, the first vertical tower, and the second vertical tower are configured to be surrounded by an outer carton to form a packaging system for a bicycle, the base tray comprising:

a bottom layer having a central panel, a first side panel formed on a first side of the central panel, and a second side panel formed on a second side of the central panel of the bottom layer and located opposite the first side panel;

a top layer having a central panel, a third side panel formed on a first side of the central panel, and a fourth side panel formed on a second side of the central panel of the top layer; and an intermediate layer disposed between the top layer and the bottom layer such that the bottom layer is positioned underneath the intermediate layer and the top layer.

11. The base tray of claim 10, wherein in a first folded position the first side panel and the second side panel of the bottom layer each extend in a direction perpendicular to the central panel of the bottom layer to form a cavity, and wherein the intermediate layer and the top layer are configured to be received within the cavity such that the intermediate layer abuts the central panel of the bottom layer and the central panel of the top layer abuts the intermediate layer.

12. The base tray of claim 11, wherein the first side panel of the bottom layer has a first central portion and the second side panel of the bottom layer has a second central portion, and wherein in a second folded position a portion of each of the first central portion and the second central portion extends above and parallel to the central panel of the top layer.

13. The base tray of claim 12, wherein the first central portion has a first tab and the second central portion has a second tab, and wherein in the second folded position the first tab is configured to extend through a recess formed within the second central portion and the second tab is configured to extend through a recess formed within the first central portion.

14. The base tray of claim 10, wherein the central panel of the top layer includes slots configured to respectively receive a rear wheel of the bicycle and a front wheel of the bicycle.

15. The base tray of claim 14, wherein the intermediate layer includes slots that align with the slots of the central panel of the top layer, wherein the slots of the intermediate layer are configured to also respectively receive the rear wheel of the bicycle and a front wheel of the bicycle.

16. A method of assembling a packaging system for a bicycle, the packaging system including a base tray having a first tab defining a first end and a second tab located opposite the first end and defining a second end, a first vertical tower, a second vertical tower, a third vertical tower, and an outer carton configured to slide over each of the base tray, the first vertical tower, the second vertical tower, and the third vertical tower, the method comprising:

inserting the first tab of the base tray into a first aperture formed within the first vertical tower to interlock the first vertical tower to the base tray at the first end;

positioning the bicycle onto the base tray such that the base tray is disposed underneath the bicycle and the first vertical tower partially surrounds a rear wheel of the bicycle;

interlocking the third vertical tower with the first vertical tower as the third vertical tower engages a frame of the bicycle;

inserting the second tab of the base tray into a second aperture formed within the second vertical tower to interlock the second vertical tower to the base tray at the second end such that the second vertical tower partially surrounds a front wheel of the bicycle; and sliding the outer carton over the base tray, the first vertical tower, the second vertical tower, and the third vertical tower.

17. The method of claim 16, further comprising:

prior to inserting the first tab of the base tray into the first aperture formed within the first vertical tower to interlock the first vertical tower to the base tray at the first end, interlocking a rear wheel brace against the first vertical tower by respectively inserting protrusions formed on the first vertical tower into apertures formed within the rear wheel brace, the rear wheel brace arranged such that the rear wheel of the bicycle is received by the rear wheel brace.

18. The method of claim 16, further comprising:

prior to inserting the second tab of the base tray into the second aperture formed within the second vertical tower to interlock the second vertical tower to the base tray at the second end, interlocking a front wheel brace against the second vertical tower by respectively inserting protrusions formed on the second vertical tower into apertures formed within the front wheel brace, the front wheel brace arranged such that the front wheel of the bicycle is received within the front wheel brace.

19. The method of claim 16, wherein interlocking the third vertical tower with the first vertical tower includes coupling a bridge to the first vertical tower and the third vertical tower such that the bridge extends therebetween.

20. A packaging system for a bicycle, the packaging system comprising:

a base tray including a first tab defining a first end, a second tab located opposite the first tab and defining a second end, a first side extending between the first tab and the second tab, and a second side extending between the first tab and the second tab and located opposite the first side, the first side and the second side defining a length of the base tray;

a first vertical tower having a first aperture configured to receive the first tab of the base tray to interlock the first vertical tower to the base tray at the first end;

a second vertical tower having a second aperture configured to receive the second tab of the base tray to interlock the second vertical tower to the base tray at the second end; and an outer carton configured to surround and interlock with the base tray, the first vertical tower, and the second vertical tower;

wherein the first vertical tower includes multiple slits formed at a bottom portion of the first vertical tower, wherein the slits are configured to be slidably received by the base tray at the first end of the base tray.

* * * * *